US007452640B2

(12) United States Patent
Shoshi et al.

(10) Patent No.: US 7,452,640 B2
(45) Date of Patent: Nov. 18, 2008

(54) ELECTROPHOTOGRAPHIC PHOTOCONDUCTOR FOR LIQUID DEVELOPMENT, IMAGE FORMING APPARATUS HAVING THE SAME, AND IMAGE FORMING METHOD

(75) Inventors: Masayuki Shoshi, Yokohama (JP); Masaomi Sasaki, Susono (JP); Akio Kojima, Mitaka (JP)

(73) Assignee: Ricoh Company, Ltd., Tokyo (JP)

( * ) Notice: Subject to any disclaimer, the term of this patent is extended or adjusted under 35 U.S.C. 154(b) by 407 days.

(21) Appl. No.: 11/190,972

(22) Filed: Jul. 28, 2005

(65) Prior Publication Data

US 2006/0024597 A1 Feb. 2, 2006

(30) Foreign Application Priority Data

Jul. 30, 2004 (JP) ..... 2004-224535

(51) Int. Cl.
*G03G 15/02* (2006.01)

(52) U.S. Cl. ..... 430/58.35; 430/73; 430/96; 430/117.2; 430/119.6; 399/159

(58) Field of Classification Search ..... 430/58.35, 430/73, 96, 117.2, 119.6; 399/159
See application file for complete search history.

(56) References Cited

U.S. PATENT DOCUMENTS

| | | | |
|---|---|---|---|
| 4,777,296 | A | 10/1988 | Sasaki |
| 4,859,556 | A | 8/1989 | Sasaki |
| 4,886,846 | A | 12/1989 | Shimada et al. |
| 4,892,949 | A | 1/1990 | Sasaki |
| 4,916,039 | A | 4/1990 | Hashimoto et al. |
| 4,925,758 | A | 5/1990 | Hashimoto et al. |
| 4,931,350 | A | 6/1990 | Shimada et al. |
| 5,047,590 | A | 9/1991 | Shimada et al. |
| 5,068,350 | A | 11/1991 | Hashimoto et al. |
| 5,072,043 | A | 12/1991 | Shoshi et al. |
| 5,081,233 | A | 1/1992 | Sasaki et al. |
| 5,097,022 | A | 3/1992 | Sasaki et al. |
| 5,098,807 | A | 3/1992 | Shimada et al. |
| 5,166,438 | A | 11/1992 | Hashimoto et al. |
| 5,219,692 | A | 6/1993 | Shimada et al. |

(Continued)

FOREIGN PATENT DOCUMENTS

JP 09-272735 * 10/1997

(Continued)

OTHER PUBLICATIONS

Machine translation of JP 2003-195535.*

(Continued)

*Primary Examiner*—Mark A Chapman
(74) *Attorney, Agent, or Firm*—Oblon, Spivak, McClelland, Maier & Neustadt, P.C.

(57) ABSTRACT

An object of the present invention is to provide an electrophotographic photoconductor for liquid development, having high resistance to a carrier solvent for use in a liquid developing method and having practically high sensitivity, an image-forming apparatus including the photoconductor, and an image forming method. To achieve this object, the present invention provides an electrophotographic photoconductor for liquid development including a support, and a photosensitive layer on or above the support, wherein the photosensitive layer includes a charge-generating material, a charge-transporting material, and an acceptor compound, and the charge-transporting material includes a charge-transporting polymer having a specified structure.

12 Claims, 1 Drawing Sheet

U.S. PATENT DOCUMENTS

| | | | |
|---|---|---|---|
| 5,233,090 | A | 8/1993 | Shimada et al. |
| 5,248,826 | A | 9/1993 | Sasaki et al. |
| 5,250,377 | A | 10/1993 | Shimada et al. |
| 5,250,733 | A | 10/1993 | Aruga et al. |
| 5,252,750 | A | 10/1993 | Hashimoto et al. |
| 5,260,156 | A | 11/1993 | Hashimoto et al. |
| 5,298,661 | A | 3/1994 | Shimada et al. |
| 5,370,954 | A | 12/1994 | Ohta et al. |
| 5,382,692 | A | 1/1995 | Shimada et al. |
| 5,420,332 | A | 5/1995 | Shimada et al. |
| 5,434,028 | A | 7/1995 | Shimada et al. |
| 5,462,826 | A | 10/1995 | Shimada et al. |
| 5,474,868 | A | 12/1995 | Adachi et al. |
| 5,480,753 | A | 1/1996 | Shimada et al. |
| 5,488,164 | A | 1/1996 | Shimada et al. |
| 5,489,495 | A | 2/1996 | Anzai et al. |
| 5,492,784 | A | 2/1996 | Yoshikawa et al. |
| 5,547,792 | A | 8/1996 | Shimada et al. |
| 5,550,293 | A | 8/1996 | Shimada et al. |
| 5,578,405 | A | 11/1996 | Ikegami et al. |
| 5,599,995 | A | 2/1997 | Tanaka et al. |
| 5,616,801 | A | 4/1997 | Shimada et al. |
| 5,616,805 | A | 4/1997 | Tanaka et al. |
| 5,623,062 | A | 4/1997 | Sasaki et al. |
| 5,631,404 | A | 5/1997 | Anzai et al. |
| 5,663,407 | A | 9/1997 | Shimada et al. |
| 5,672,728 | A | 9/1997 | Tanaka et al. |
| 5,700,614 | A | 12/1997 | Kawahara et al. |
| 5,808,155 | A | 9/1998 | Shimada et al. |
| 5,846,680 | A | 12/1998 | Adachi et al. |
| 5,863,683 | A | 1/1999 | Ohta et al. |
| 5,910,561 | A | 6/1999 | Adachi et al. |
| 5,942,362 | A | 8/1999 | Tadokoro et al. |
| 5,976,746 | A | 11/1999 | Tanaka et al. |
| 6,045,959 | A | 4/2000 | Katayama et al. |
| 6,066,428 | A | 5/2000 | Katayama et al. |
| 6,068,956 | A | 5/2000 | Namba et al. |
| 6,074,792 | A | 6/2000 | Namba et al. |
| 6,093,784 | A | 7/2000 | Tamura et al. |
| 6,130,310 | A | 10/2000 | Katayama et al. |
| 6,172,176 | B1 | 1/2001 | Tanaka et al. |
| 6,187,492 | B1 | 2/2001 | Ri et al. |
| 6,187,494 | B1 | 2/2001 | Kawamura et al. |
| 6,194,535 | B1 | 2/2001 | Katayama et al. |
| 6,210,848 | B1 | 4/2001 | Nagai et al. |
| 6,303,736 | B1 | 10/2001 | Kawamura et al. |
| 6,444,387 | B2 | 9/2002 | Ri et al. |
| 6,465,648 | B1 | 10/2002 | Tadokoro et al. |
| 6,486,293 | B1 | 11/2002 | Ri et al. |
| 6,544,701 | B2 | 4/2003 | Tadokoro et al. |
| 6,576,386 | B1 | 6/2003 | Ri et al. |
| 6,664,361 | B2 | 12/2003 | Sasaki et al. |
| 6,790,571 | B2 | 9/2004 | Kawamura et al. |
| 6,849,367 | B2 | 2/2005 | Shoshi et al. |
| 6,919,419 | B2 | 7/2005 | Ri et al. |
| 2003/0059695 | A1 | 3/2003 | Li et al. |
| 2005/0003287 | A1 | 1/2005 | Kawamura et al. |
| 2005/0106483 | A1 | 5/2005 | Shoshi et al. |

FOREIGN PATENT DOCUMENTS

| | | | |
|---|---|---|---|
| JP | 2000-63456 | | 2/2000 |
| JP | 2000-214610 | | 8/2000 |
| JP | 2002-40677 | | 2/2002 |
| JP | 2002-116560 | | 4/2002 |
| JP | 2002-131943 | | 5/2002 |
| JP | 2002-351101 | | 12/2002 |
| JP | 2003-5391 | | 1/2003 |
| JP | 2003-57856 | | 2/2003 |
| JP | 2003-195535 | * | 7/2003 |

OTHER PUBLICATIONS

Machine translation of JP 09-272735.*
U.S. Appl. No. 08/197,853, filed Feb. 17, 1994, Tamotsu Aruga et al.
U.S. Appl. No. 08/453,827, filed May 30, 1995, Tamotsu Aruga et al.
U.S. Appl. No. 10/943,262, filed Sep. 17, 2004, Yuko Arizumi et al.

* cited by examiner

ELECTROPHOTOGRAPHIC PHOTOCONDUCTOR FOR LIQUID DEVELOPMENT, IMAGE FORMING APPARATUS HAVING THE SAME, AND IMAGE FORMING METHOD

BACKGROUND OF THE INVENTION

1. Field of the Invention

The present invention relates to electrophotographic photoconductors for liquid development, which are used for image forming according to a liquid developing method that uses a developing solution containing toner particles in a liquid, image-forming apparatuses comprising the photoconductors and image-forming methods.

2. Description of the Related Art

Photoconductors for use in an electrophotographic type have been roughly categorized into two types, that is, an inorganic photoconductor and organic photoconductor. Here, the electrophotographic type refers to an image-forming process, so called Carlson Process. Specifically, in general, photoconductor is initially charged, for example, by a corona discharge in the dark, is exposed imagewise, the charge only at the exposed portion is scattered selectively to obtain an electrostatic latent image, this latent image portion is developed using a toner comprising a colorant, such as a dye and a pigment, and a polymer material, and the latent image is visualized to thereby form an image.

The developing method in the electrophotography according to the Carlson Process is mainly classified into a dry developing method and a wet developing method or liquid developing method. At the present, the image-forming apparatus using the dry developing method is widely applied, for example a copying machine, and a printer, and is commonly used. On the other hand, the image-forming apparatus utilizing the wet developing method has been developed and commercialized from the old times. However, the image-forming apparatus using the dry developing method accounts for most of the market.

However, with respect to the image-forming apparatus utilizing the wet developing method, generally, the toner is dispersed in a liquid and the toner particles can be rendered extremely fine, thus the obtained image can possess an extremely high image quality. Therefore, in recent years, accompanying with a market expansion of a full color printer to which a high image quality is required, the image-forming apparatus utilizing the wet developing method is attracting the attention again and the development thereof is progressed.

As mentioned above, since the image-forming apparatus utilizing the wet developing method uses a developing solution in which the toner particles are dispersed in a liquid, the whole part or a part of the used photoconductor is immersed in the above-noted liquid developing solution. As for the liquid (carrier solvent) used for the developing solution, for example, an aliphatic hydrocarbon solvent, which is called Isopar (trade name; manufactured by Exxon Chemicals), a silicone oil, or the like is mainly used. As for a photoconductor, an inorganic photoconductor, such as selenium and amorphous silicon, by which a photoconductor component is not eluted into a carrier solvent is generally used.

On the other hand, an organic photoconductor is advantageous, in comparison with an inorganic photoconductor, in available wavelength region for exposure, film-forming properties, flexibility, transparency of film, mass-productivity, toxicity and cost, thus the photoconductor in which an organic material is used has been actively developed and is put into practice.

This kind of organic photoconductor is mainly classified into a laminated layer photoconductor comprising a charge-generating layer having a charge generating function and a charge-transporting layer having a charge transporting function; and a single-layer photoconductor comprising a single layer having both the charge generating function and the charge transporting function. The former has a configuration in which a charge-generating layer and a charge-transporting layer are disposed on the support in this order, and is applied mainly to an image forming apparatus according to a negative charging system from a restriction with respect to an organic material. The former is excellent in photosensitive properties and durability, thus is widely put into practice. On the other hand, the latter has a configuration in which a single photosensitive layer is disposed on the support and is applied from the viewpoint of easiness in principle to obtain a high image resolution, mainly to an image-forming apparatus according to a positive charging system.

Therefore, an inorganic photoconductor, such as selenium and amorphous silicon, which is generally used in an image-forming apparatus utilizing the above-mentioned wet developing method, is usually used by positively charging the photoconductor, thus when a conventional inorganic photoconductor is replaced by an organic photoconductor, it is advantageous that a single-layer photoconductor can be used in the same image-forming apparatus according to the positively charging system as that in which an inorganic photoconductor is previously used.

When a commonly used organic photoconductor is employed in an image-forming apparatus utilizing a wet developing method, as mentioned above, the whole or a part of used photoconductor is immersed in a liquid developing solution (carrier solvent), resulting in the cracking of the photoconductor due to the contact with the carrier solvent, the crystallization of the compound having a low molecular mass, such as a charge-transporting material and/or an acceptor compound, or the elusion of these compounds into the developing solution. This brings about a remarkable deterioration not only mechanically but also electrically, accordingly a satisfactory image cannot be obtained.

Thus, an organic photoconductor has been proposed in which an overcoat layer (surface protective layer) containing a thermosetting resin such as a silicone resin, an epoxy resin and a melamine resin, which is insoluble in a liquid developing solution, is disposed on the surface of the organic photoconductor. However, by disposing the overcoat layer, new problems arise that the sensitivity of the photoconductor is extremely impaired, and besides production cost becomes high.

Alternatively, as a method in which the overcoat layer is not disposed, Japanese Patent Application Laid-Open (JP-A) Nos. 2002-116560, 2002-131943, 2002-351101, 2002-40677, 2000-214610 and 2003-5391 propose a single-layer photoconductor for use in the wet developing method. By using a specific binder resin, the single-layer photoconductor has high resistance to a carrier solvent used in the wet developing method, a charge-transporting material does not elute into this solvent, and the photoconductor has a practical sensitivity.

In these proposals, a binder resin having a relatively high polarity is used, thereby improving the resistance of the photoconductor to a carrier solvent having a low polarity. Therefore, the elution of the charge-transporting material is substantially inevitable, causing a problem that such a photoconductor is not durable to a long-term usage.

Further, JP-A No. 2000-63456 proposes a copolymer between a chemical structure block having a charge transporting function and a chemical structure block of the binder resin; and a single-layer photoconductor using the same. In this proposition, it is described that when this copolymer is used in an electrophotographic photoconductor according to a wet developing method, the elution of a compound having a low molecular mass of the photoconductor caused by a liquid developing solution can be prevented. This single-layer photoconductor has a certain level of sensitivity; however, not so high as to satisfy the requirement of the market fully.

Further, JP-A No. 2003-57856 proposes a copolymer between a chemical structure block having a charge transporting function and a chemical structure block of the binder resin; and a single-layer photoconductor using the above-mentioned copolymer.

However, since the above-proposed copolymer comprises a chemical structure block having a charge transporting function in an amount of 5 mol % to 30 mol %, the charge transporting does not exhibit satisfactory charge transport performance. When only the copolymer assumes the charge transporting function, satisfactory sensitivity of the photoconductor cannot be obtained. Therefore, for obtaining satisfactory sensitivity, as shown in Examples, addition of a charge-transporting material having a low molecular mass is required. When such a photoconductor is used as an electrophotographic photoconductor according to a wet developing method, there is a problem that the elution of the charge-transporting material having a low molecular mass caused by a liquid developing solution is inevitable and the photoconductor is not durable to a long-term usage.

SUMMARY OF THE INVENTION

Accordingly, an object of the invention is to provide an electrophotographic photoconductor for liquid development, having high resistance to a carrier solvent for use in a liquid developing method and having practically high sensitivity, an image-forming apparatus comprising the photoconductor, and an image forming method.

The electrophotographic photoconductor for liquid development comprises a support, and a photosensitive layer on or above the support, wherein the photosensitive layer comprises a charge-generating material, a charge-transporting material, and an acceptor compound, wherein the photosensitive layer comprises a charge-generating material, a charge-transporting material and an acceptor compound, wherein the charge-transporting material comprises a charge-transporting polymer represented by the following General Formula (1):

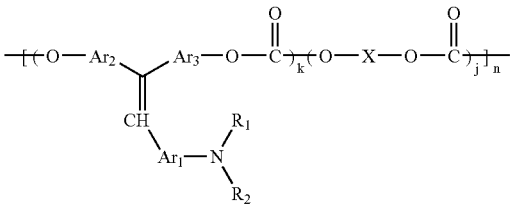

General Formula (1)

where, in the General Formula (1), $R_1$ and $R_2$ may be the same or different and represent an unsubstituted or substituted aryl group; $Ar_1$, $Ar_2$, and $Ar_3$ may be the same as or different from each other and represent an unsubstituted or substituted arylene group; "k" and "j" represent a composition ratio and $0.1 \leqq k \leqq 1$, $0 \leqq j \leqq 0.9$; "n" represents a recurring unit and is an integer of 5 to 5,000; "X" represents a divalent aliphatic group, a divalent cyclic aliphatic group, or a divalent group represented by the following General Formula (A):

General Formula (A)

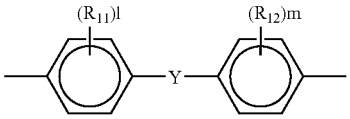

where, in the General Formula (A), $R_{11}$ and $R_{12}$ may be the same or different and represent an unsubstituted or substituted alkyl group, an unsubstituted or substituted aryl group, or a halogen atom; "l" and "m" represents an integer of 0 to 4; "Y" represents a single bond, a straight, branched, or cyclic alkylene group having a carbon number of 1 to 12, —O—, —S—, —SO—, —$SO_2$—, —CO—, —CO—O-Z-O—CO— (in the formula, "z" represents a divalent aliphatic group), or a group represented by the following General Formula (B):

General Formula (B)

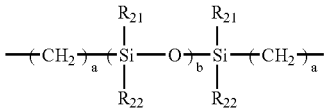

where, in the General Formula (B), "a" represents an integer of 1 to 20, and "b" represents an integer of 1 to 2,000; and $R_{21}$ and $R_{22}$ may be the same or different and represent an unsubstituted or substituted alkyl group, or unsubstituted or substituted aryl group.

The image-forming apparatus of the invention comprises an electrophotographic photoconductor, an electrostatic latent image forming unit configured to form an electrostatic latent image on the electrophotographic photoconductor, a developing unit configured to develop the electrostatic latent image by means of a toner to form a visible image, a transferring unit configured to transfer the visible image on a recording medium, and a fixing unit configured to fix the transferred image on the recording medium, wherein the electrophotographic photoconductor is the electrophotographic photoconductor for liquid development according to the invention.

The image forming method of the invention comprises forming an electrostatic latent image on an electrophotographic photoconductor, developing the electrostatic latent image by means of a toner to form a visible image, transferring the visible image on a recording medium, and fixing the transferred image on the recording medium, wherein the electrophotographic photoconductor is the electrophotographic photoconductor for liquid development according to the invention.

Figure 1:
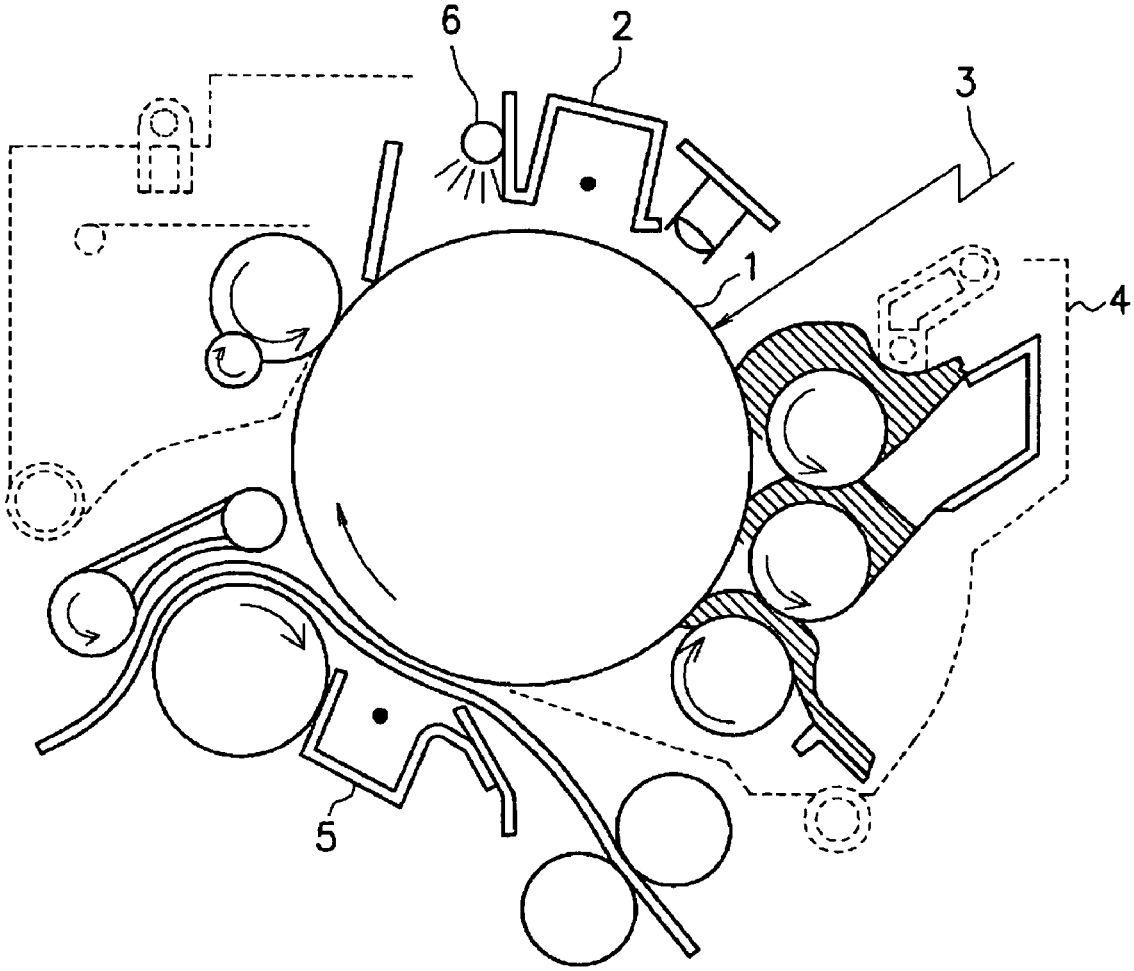
FIG. 1 is a schematic view illustrating an example of an image-forming apparatus of the invention, comprising an electrophotographic photoconductor for liquid development.

DESCRIPTION OF THE PREFERRED EMBODIMENTS (Electrophotographic Photoconductor for Liquid Development)

The electrophotographic photoconductor for liquid development of the invention comprises a support and a photosensitive layer thereon, and may comprise an intermediate layer, and other layers according to necessity.

The photosensitive layer comprises a charge-generating material, a charge-transporting material and an acceptor compound and other components according to necessity.

With respect to the photosensitive layer of the electrophotographic photoconductor for liquid development according to the invention, it is particularly important that as the charge-transporting material, a charge-transporting polymer is used. This makes it possible to achieve a single-layer electrophotographic photoconductor having extremely high resistance to a carrier solvent for use in a liquid developing method and having practically high sensitivity. The reason for this is not clear at present; however, it is assumed as follows.

It is considered that high resistance of the charge-transporting polymer having a specified structure, to a carrier solvent for use in a liquid developing method further increases the resistance to a carrier solvent. It is assumed that a compound having a low molecular mass, such as an acceptor compound having a specified structure or a phenolic compound having a specified structure, which is present in such solid matrix of the charge-transporting polymer, has a certain interaction with the charge-transporting polymer, and as a result, the resistance of the electrophotographic photoconductor comprising the charge-transporting polymer according to this aspect, to the carrier solvent has extremely increased.

As the interaction, for example, the interaction of the acceptor compound having a specified structure with the charge-transporting polymer is assumed to be based on an intermolecular charge transfer, and the interaction of the phenolic compound having a specified structure with the charge-transporting polymer is assumed to be based on a hydrogen bond or a van der Waals force. Further, for the above-mentioned interaction, the structural factors of the charge-transporting polymer, acceptor compound and phenolic compound according to this aspect are also important. Thus, it is assumed that due to the synergism of these structural factors, intended photoconductor can be achieved.

On the contrary, as for the reason for high sensitivity, it is assumed that an extremely homogeneous polymer matrix (dispersed in molecular order) is produced based on the above-mentioned interaction, a charge is injected from the charge-generating material into a charge-transfer matrix, and thus a smooth charge transfer through the matrix is achieved, that is, high sensitivity is achieved.

The electrophotographic photoconductor of the invention will be described in more detail below. As mentioned above, the electrophotographic photoconductor for liquid development is provided with the photosensitive layer comprising the charge-transporting polymer having a specified structure represented by the following General Formula (1), as a charge-transporting material.

General Formula (1)

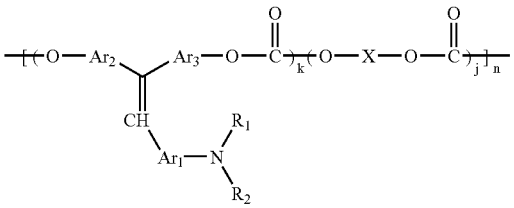

In the General Formula (1), $R_1$ and $R_2$ may be the same or different, and represent an unsubstituted or substituted aryl group. $Ar_1$, $Ar_2$, and $Ar_3$ may be the same as or different from each other and represent an unsubstituted or substituted arylene group. "k" and "j" represent a composition ratio and $0.1 \leqq k \leqq 1$, $0 \leqq j \leqq 0.9$. "n" represents a recurring unit and is an integer of 5 to 5,000. "X" represents a divalent aliphatic group, a divalent cyclic aliphatic group, or a divalent group represented by the following General Formula (A).

General Formula (A)

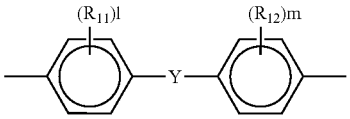

In the General Formula (A), $R_{11}$ and $R_{12}$ may be the same or different, and represent an unsubstituted or substituted alkyl group, unsubstituted or substituted aryl group or halogen atom. "l" and "m" represents an integer of 0 to 4. "Y" represents a single bond, a straight, branched, or cyclic alkylene group having a carbon number of 1 to 12, —O—, —S—, —SO—, —$SO_2$—, —CO—; —CO—O-Z-O—CO— (in the formula, "Z" represents a divalent aliphatic group) or the groups represented by the following General Formula (B).

General Formula (B)

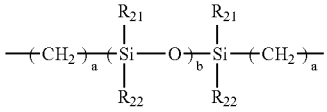

In the General Formula (B), "a" represents an integer of 1 to 20, and "b" represents an integer of 1 to 2,000. $R_{21}$ and $R_{22}$ may be the same or different, and represent an unsubstituted or substituted alkyl group; or unsubstituted or substituted aryl group.

As for the charge-transporting polymer represented by the General Formula (1), examples of the aryl group of $R_1$ and $R_2$ include aromatic hydrocarbons groups such as a phenyl group; condensed polycyclic groups such as a naphthyl group, pyrenyl group, 2-fluorenyl group, 9,9-dimethyl-2-fluorenyl group, azurenyl group, anthoryl group, triphenylenyl group, chrysenyl group, fluorenilidenephenyl group, and 5H-dibenzo [a,d] cycloheptenilidenephenyl group; heterocyclic groups such a thienyl group, benzothienyl group, furyl group, benzofuranyl group, carbazolyl group; non-condensed polycyclic groups such as a biphenylyl group, terphenylyl group, non-condensed groups represented by the following General Formula (i); and the like.

General Formula (i)

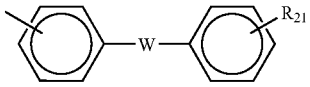

In the General Formula (i), W represents —O—, —S—, —SO—, —$SO_2$—, —CO—, or a divalent group represented by the following General Formula (ii), General Formula (iii), General Formula (iv), or General Formula (v).

General Formula (ii)

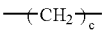

-continued

General Formula (iii)

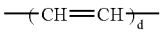

General Formula (iv)

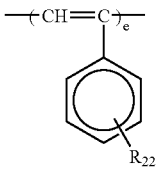

General Formula (v)

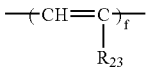

In the General Formulae (ii) to (v), "c" represents an integer of 1 to 12, and "d", "e" and "f" represent an integer of 1 to 3, respsectively.

Further, as the arylene group of $Ar_1$, $Ar_2$, and $Ar_3$ in the General Formula (1), divalent aryl groups exemplified in the description of $R_1$ and $R_2$ are exemplified. The aryl group of $R_1$ and $R_2$, and arylene group of $Ar_1$, $Ar_2$, and $Ar_3$ may have the group indicated below as a substituent. Further, these substituents are also specific examples of $R_{21}$, $R_{22}$, or $R_{23}$ in the above-mentioned General Formula (i), General Formula (iv), or General Formula (v).

(1) A halogen atom, trifluoromethyl group, cyano group, nitro group (2) An alkyl group: straight- or branched-chain alkyl groups having a carbon number of preferably 1 to 12, in particular 1 to 8, more preferably 1 to 4, these alkyl groups may further contain a fluorine atom, hydroxy group, cyano group, alkoxy group having a carbon number of 1 to 4, phenyl group, phenyl group substituted with a halogen atom, alkyl group having a carbon number of 1 to 4, or alkoxy group having a carbon number of 1 to 4, or the like. Specific examples include a methyl group, ethyl group, n-propyl group, i-propyl group, t-butyl group, s-butyl group, n-butyl group, i-butyl group, trifluoromethyl group, 2-hydroxyethyl group, 2-cyanoethyl group, 2-ethoxyethyl group, 2-methoxyethyl group, benzyl group, 4-chlorobenzyl group, 4-methylbenzyl group, 4-methoxybenzyl group, 4-phenylbenzyl group, and the like.

(3) An alkoxy group (—$OR_{31}$): $R_{31}$ represents the alkyl groups described in the above-mentioned (2). Specific examples thereof include a methoxy group, ethoxy group, n-propoxy group, i-propoxy group, t-butoxy group, n-butoxy group, s-butoxy group, i-butoxy group, 2-hydroxyethoxy group, 2-cyanoethoxy group, benzyloxy group, 4-methylbenzyloxy group and trifluoromethoxy group, and the like.

(4) An aryloxy group: as an aryl group, a phenyl group, and naphthyl group are exemplified. These may contain an alkoxy group having a carbon number of 1 to 4, alkyl group having a carbon number of 1 to 4, or halogen atom as a substituent. Specific examples thereof include a phenoxy group, 1-naphthyloxy group, 2-naphthyloxy group, 4-methylphenoxy group, 4-methoxyphenoxy group, 4-chlorophenoxy group, 6-methyl-2-naphthyloxy group, and the like.

(5) A substituted mercapto group or arylmercapto group: Specific examples thereof include methylthio group, ethylthio group, phenylthio group, p-methylphenylthio group, and the like.

(6) Substituted amino group represented by General Formula: —$N(R_{41})(R_{42})$ (In the Formula, $R_{41}$ and $R_{42}$ individually represent the alkyl groups described by the above-mentioned (2), or the aryl groups described in $R_1$ and $R_2$. Preferable examples of the aryl group include a phenyl group, biphenyl group, or naphthyl group, and these may contain an alkoxy group having a carbon number of 1 to 4, alkyl group having a carbon number of 1 to 4, or halogen atom as a substituent. Further, $R_{41}$ and $R_{42}$ may form a ring together with a carbon atom contained in the aryl group. Specific examples thereof include a diethylamino group, N-methyl-N-phenylamino group, N,N-diphenylamino group, N,N-di(p-tolyl)amino group, dibenzylamino group, piperidino group, morpholino group, julolidyl group, and the like.

(7) A alkylene dioxy group such as methylene dioxy group, an alkylene dithio group such as a methylene dithio group, and the like.

When a diol compound having a triarylamino group, represented by the following General Formula (3) is subjected to polymerization by means of phosgene method ester interchange method, together with a diol compound represented by the following General Formula (C), "X" is introduced into a main chain. In this case, the polycarbonate resin to be produced is in the form of a random copolymer or block copolymer. Alternatively, "X" can be introduced into the recurring unit by the polymerization reaction of the diol compound having a triarylamino group, represented by the following General Formula (3) and a bischloroformate derived from the diol compound represented by the following General Formula (C). In this case, the polycarbonate resin to be produced is in the form of an alternating copolymer.

General Formula (3)

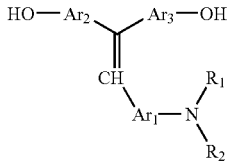

General Formula (C)

Specific examples of the diol compound of General Formula (C) include aliphatic diols such as 1,3-propanediol, 1,4-butanediol, 1,5-pentanediol, 1,6-hexanediol, 1,8-octanediol, 1,10-decanediol, 2-methyl-1,3-propanediol, 2,2-dimethyl-1,3-propanediol, 2-ethyl-1,3-propanediol, diethylene glycol, triethylene glycol, polyethylene glycol and polytetramethylene ether glycol; and cyclic aliphatic diols such as 1,4-cyclohexanediol, 1,3-cyclohexanediol and cyclohexane-1,4-dimethanol.

Further, examples of the diol compound having an aromatic ring include 4,4'-dihydroxydiphenyl, bis(4-hydroxyphenyl)methane, 1,1-bis(4-hydroxyphenyl)ethane, 1,1-bis(4-hydroxyphenyl)-1-phenylethane, 2,2-bis(4-hydroxyphenyl)propane, 2,2-bis(3-methyl-4-hydroxyphenyl)propane, 1,1-bis(4-hydroxyphenyl)cyclohexane, 1,1-bis(4-hydroxyphenyl)cyclopentane, 2,2-bis(3-phenyl-4-hydroxyphenyl)propane, 2,2-bis(3-isopropyl-4-hydroxyphenyl)propane, 2,2-bis(4-hydroxyphenyl)butane, 2,2-bis(3,5-dimethyl-4-hydroxyphenyl)propane, 2,2-bis(3,5-dibromo-4-hydroxyphenyl)propane, 4,4'-dihydroxydiphenylsulfone, 4,4'-dihydroxydiphenylsulfoxide, 4,4'-dihydroxydiphenylsulfide, 3,3'-dimethyl-4,4'-dihydroxydiphenylsulfide, 4,4'-dihydroxydiphenyloxide, 2,2-bis(4-hydroxyphenyl)hexafluoropropane, 9,9-bis(4-hydroxyphenyl)fluorene, 9,9-bis(4-hydroxyphenyl)xanthene, ethylene glycol-bis(4-hydroxybenzoate), diethylene glycol-bis(4-hydroxybenzoate), triethylene glycol-bis(4-hydroxybenzoate), 1,3-bis(4-hydroxyphenyl)-tetramethyldisiloxane, phenol-modified silicone oil, and the like.

Below shown are the exemplified compounds of the General Formula (1). However, this aspect is not limited to these compounds. In the exemplified compounds, "n" represents the number of monomer units and is an integer of 5 to 5,000.

<The Exemplified Compounds Correspond to Prior Patent Application JP-A No. 9-272735>

(D-01)

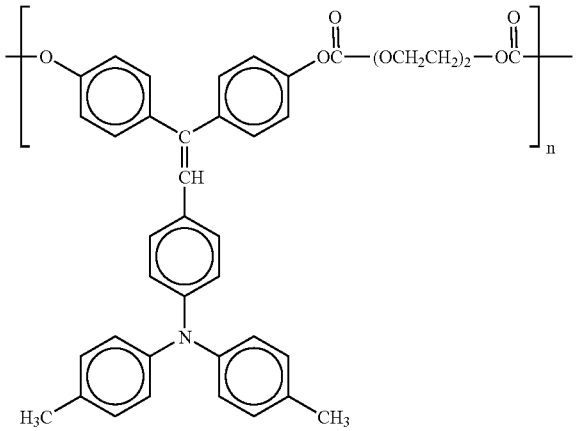

(D-02)

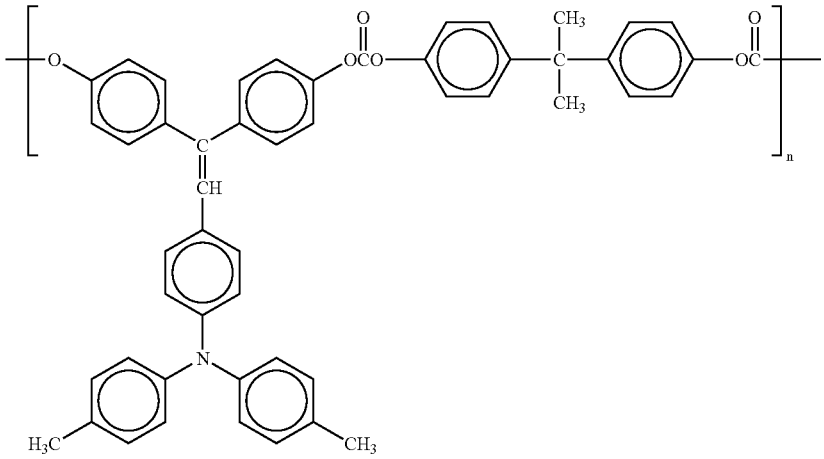

(D-03)

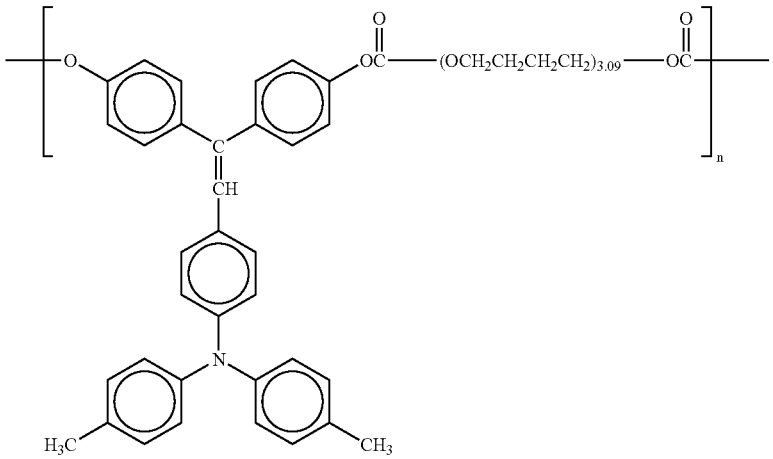

-continued
(D-04)
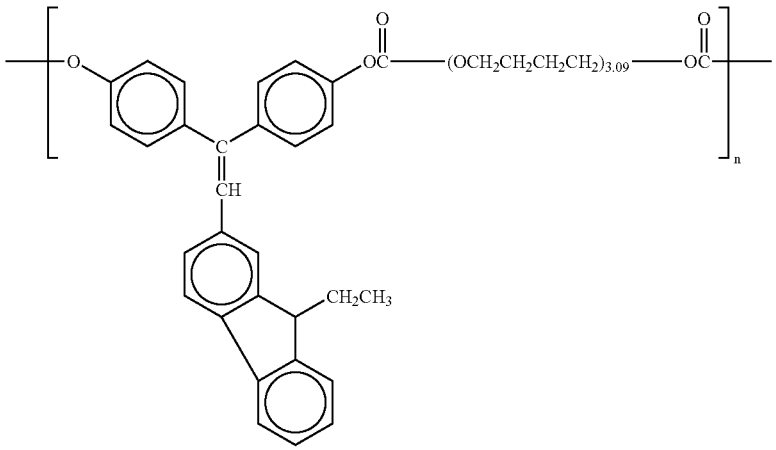
(D-05)
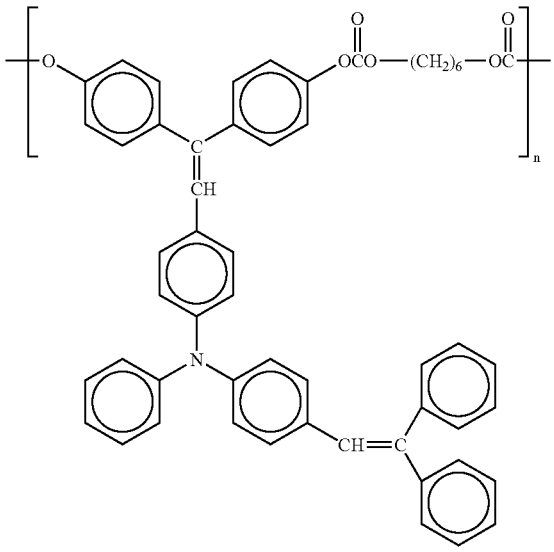
(D-06)
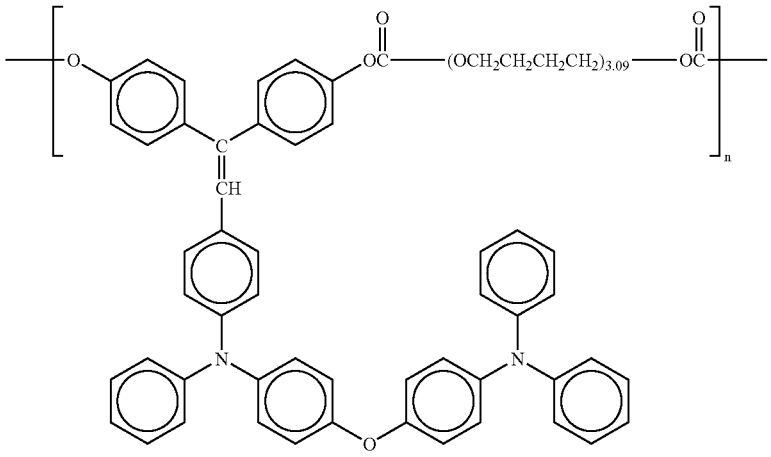

-continued
(D-07)
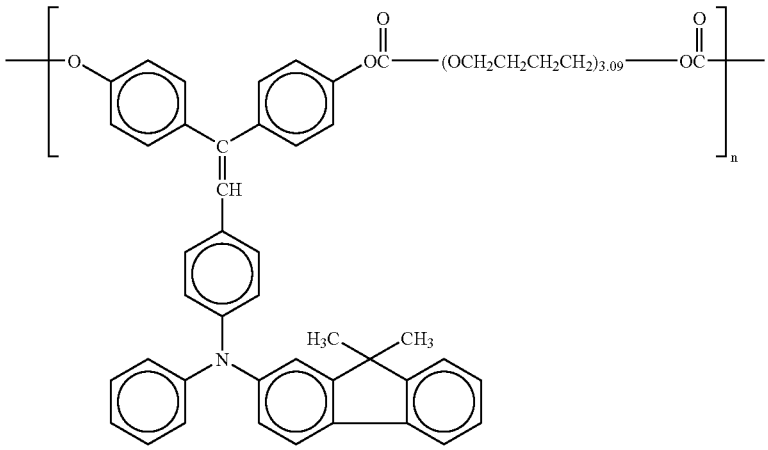
(D-08)
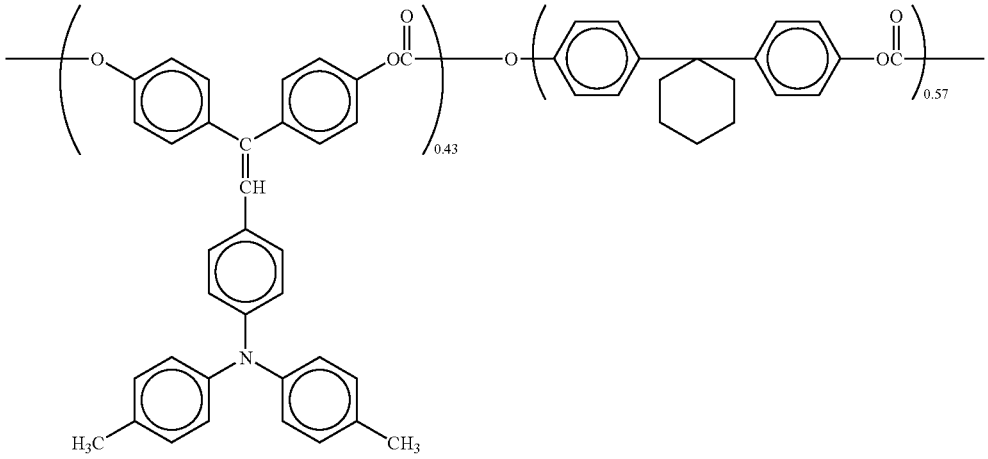
(D-09)
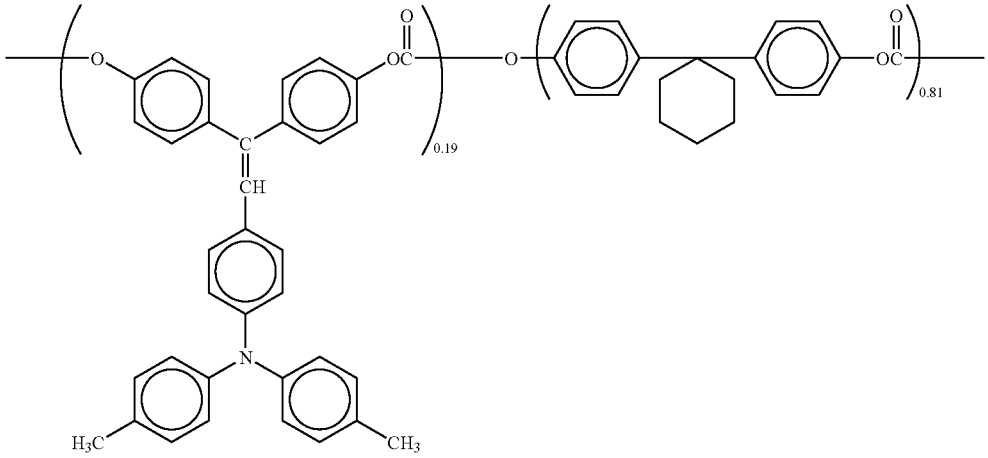

-continued
(D-10)
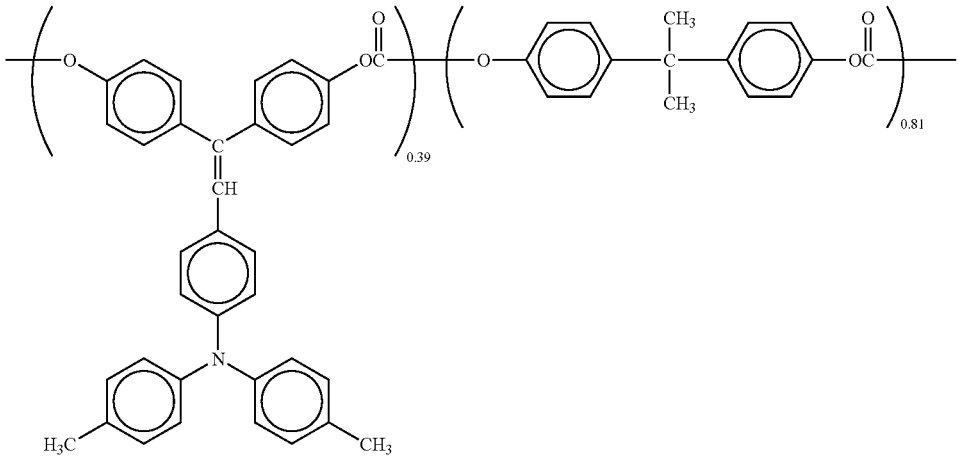
(D-11)
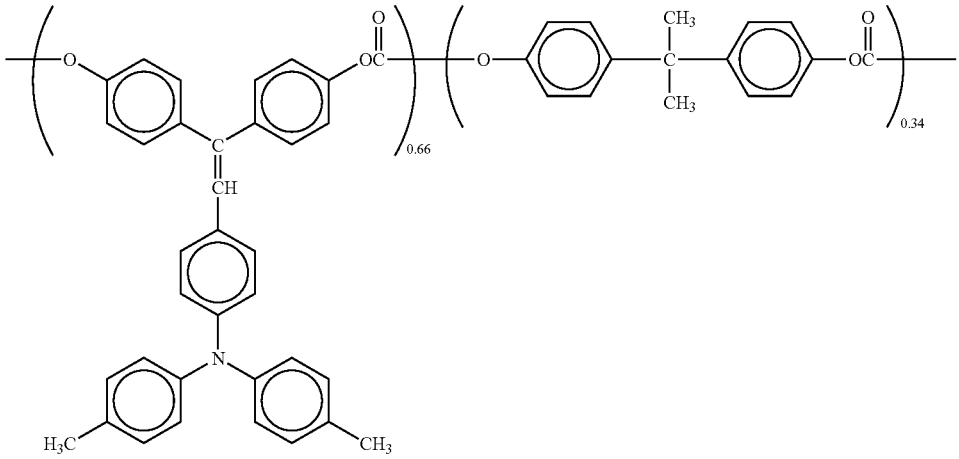
(D-12)
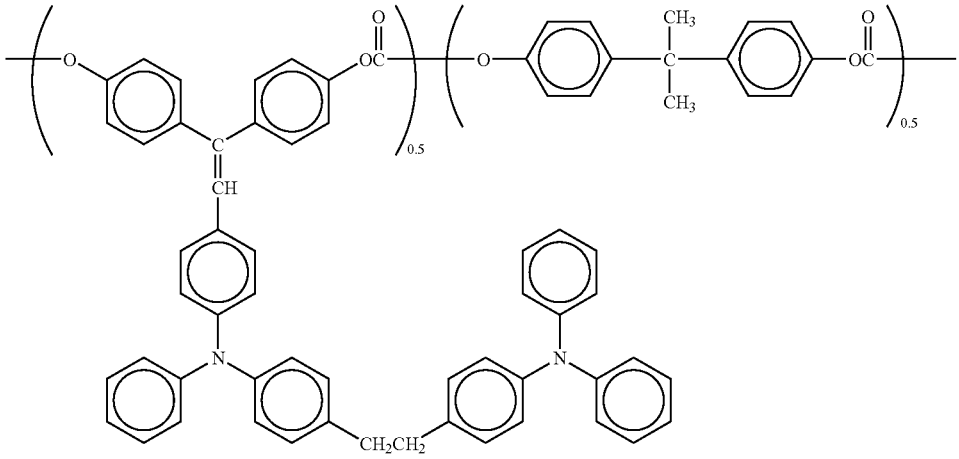

-continued
(D-13)
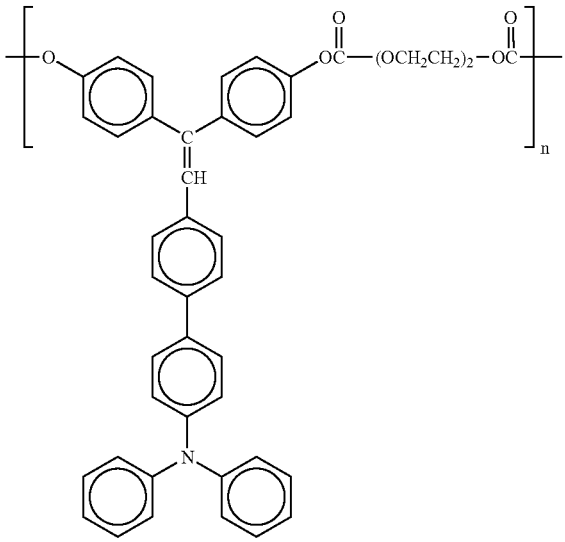
(D-14)
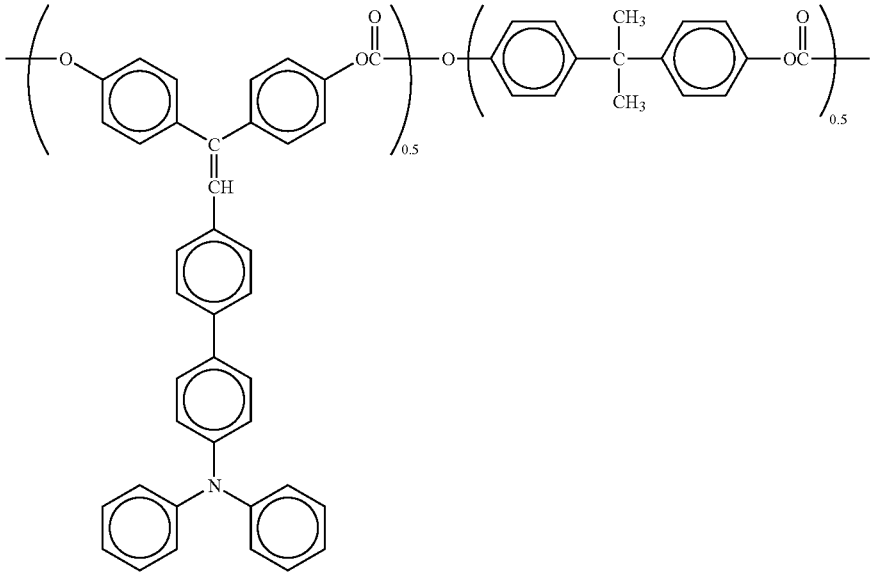
(D-15)
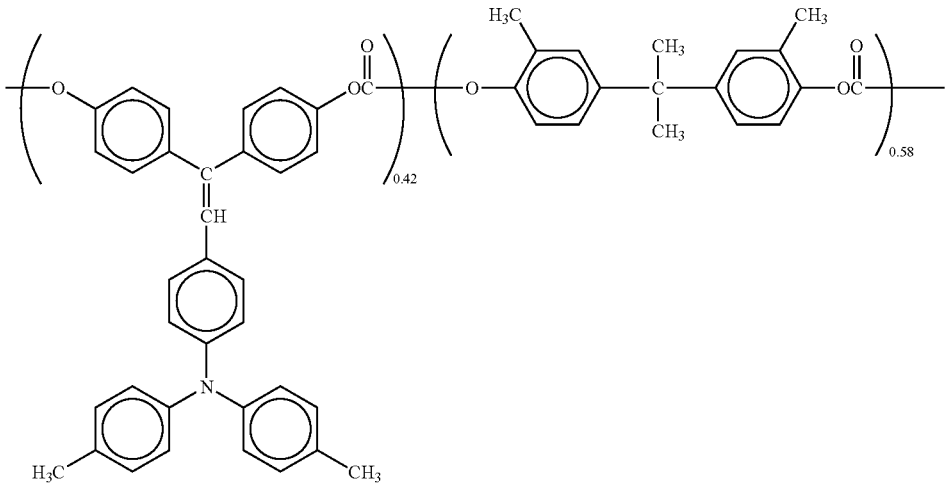

-continued (D-16)

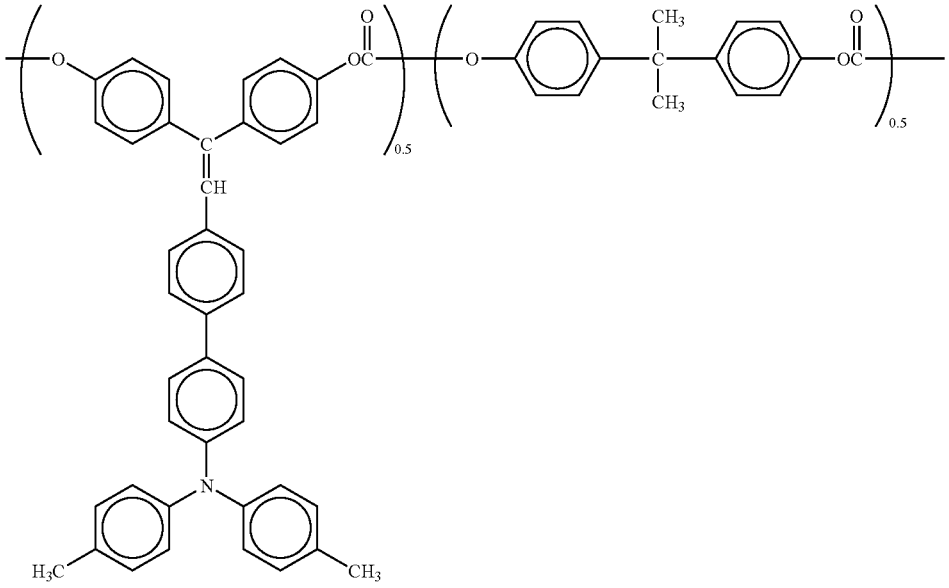

The content of the charge-transporting polymer in the photosensitive layer is preferably 20% by mass to 95% by mass, more preferably 30% by mass to 80% by mass. When the content of the charge-transporting polymer is less than 20% by mass, the lowering of the sensitivity of the photoconductor may be caused due to insufficient charge-transporting material. On the other hand, when the content of the charge-transporting polymer exceeds 95% by mass, the lowering of the sensitivity of the photoconductor may be caused due to insufficient charge-generating material and acceptor compound.

The mass average molecular mass of the charge-transporting polymer is preferably 7,000 to 1,000,000, and more preferably 10,000 to 500,000, relative to polystyrene standards, determined by gel permeation chromatography. When the molecular mass is too small, film-forming properties may be deteriorated, for example, by the occurrence of a crack, and the resistance of the photoconductor to a carrier liquid becomes unsatisfactorily, resulting in poor practicality. On the other hand, when the molecular mass is too large, the solubility of the polymer in a general organic solvent is deteriorated, and thus the viscosity of the solution increases, making the coating difficult. Therefore, in this case, too, the photoconductor lack in practicality.

The polymer exhibits satisfactory solubility in a variety of general organic solvents, such as dichloromethane, tetrahydrofuran, chloroform, toluene, monochlorobenzene and xylene. Therefore, a variety of photoconductors may be produced by preparing a coating liquid having a proper concentration, of which solvent is a proper solvent capable of dissolving the polymer according to this aspect, and then by coating the coating liquid according to a conventional coating method.

The production method of the compound represent by the General Formula (1) is described in JP-A No. 9-272735 and the like.

The photosensitive layer comprises an acceptor compound as an essential component. As the acceptor compound, 2,3-diphenylindene compound represented by the following General Formula (F) is preferred.

General Formula (F)

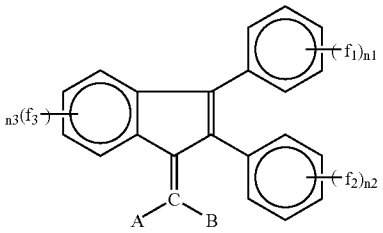

In the General Formula (F), $f_1$, $f_2$ and $f_3$ may be the same as or different from each other and represent any one of a hydrogen atom, halogen atom, cyano group, nitro group, and alkyl group which may be substituted with a substituent. "A" and "B" may be the same or different and represent any one of a hydrogen atom, cyano group, aryl group which may be substituted with a substituent, and alkoxycarbonyl group which may be substituted with a substituent, and aryloxycarbonyl group which may be substituted with a substituent. "n1" and "n2" represent an integer of 0 to 5. "n3" represents an integer of 0 to 5.

In the 2,3-diphenylindene compound represented by the General Formula (F), $f_1$, $f_2$ and $f_3$ represent individually any one of a hydrogen atom; halogen atom, such as a fluorine atom and chlorine atom; alkyl group, such as a methyl group, ethyl group, n-propyl group, isopropyl group, n-butyl group and t-butyl group; benzyl group; substituted alkyl group, such as a methoxymethyl group and methoxyethyl group; cyano group; and nitro group. A and B represent individually any one of a hydrogen atom; halogen atom, such as a fluorine atom and chlorine atom; alkyl group, such as a methyl group, ethyl group, n-propyl group, isopropyl group, n-butyl group, and t-butyl group; benzyl group; substituted alkyl group, such as a methoxymethyl group and methoxyethyl group; cyano group; alkoxycarbonyl group, such as a methoxycarbonyl group and ethoxycarbonyl group; benzyloxycarbonyl group; substituted alkylcarbonyl group, such as a methoxyethylcarbonyl group; and aryl group, such as a phenyl group and naphthyl group. Examples of the substituent which A and B may have include an alkyl group, such as a methyl group and ethyl group; phenyl group; methoxy group; ethoxy group; phenoxy group; and halogen atom, such as a fluorine atom and chlorine atom.

Among these, which are represented by the above-mentioned General Formula (F), in particular, (2,3-diphenyl-1-indene) malonnitrile represented by the following General Formula (A-1) is preferably employed.

General Formula (A-1)

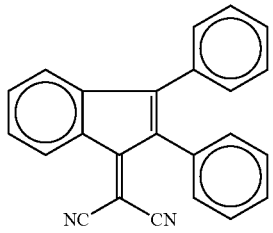

As the acceptor compound, conventional compounds may also be employed. Examples thereof include chloranyl, bromanyl, tetracyanoethylene, tetracyanoquinodimethane, 2,4,7-trinitro-9-fluorenone, 2,4,5,7-tetranitro-9-fluorenone, 2,4,5,7-tetranitroxantone, 2,4,8-trinitrothioxantone, 2,6,8-trinitro-indeno4H-indeno[1,2-b]thiophene-4-on, 1,3,7-trinitrodibenzothiophene-5,5-dioxide, and the like. Further, acceptor compounds represented by the following Formulas (A-2), (A-3) and (A-4) can be preferably employed.

(A-2)

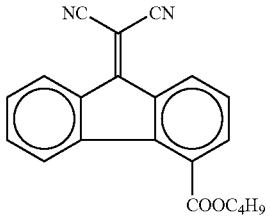

(A-3)

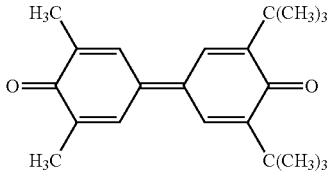

(A-4)

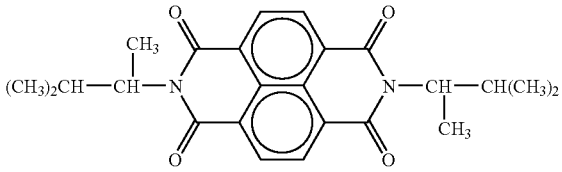

These acceptor compounds may be used alone or in combination. The content of the acceptor compound in the photosensitive layer is preferably 1% by mass to 40% by mass, more preferably 5% by mass to 40% by mass. When the content of the acceptor compound is less than 1% by mass, the lowering of the sensitivity of the photoconductor may be caused and the durability of the photoconductor in repeated use may be deteriorated. On the other hand, when the content of the acceptor compound exceeds 40% by mass, the lowering of the sensitivity of the photoconductor may be caused because required amounts of the charge-generating material and charge-transporting polymer are not ensured.

The production method of the compound represent by the General Formula (F) is described in JP-A No. 7-300434 and the like.

Further, it is preferable that the photosensitive layer comprise a phenolic compound according to necessity.

As the phenolic compound, for example, a phenolic compound represented by the General Formula (G1) is preferred.

General Formula (G1)

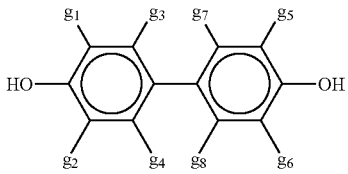

In the General Formula (G1), "$g_1$" to "$g_8$" represent a hydrogen atom; an unsubstituted or substituted alkyl group; an unsubstituted or substituted alkoxycarbonyl group; an unsubstituted or substituted aryl group; or an unsubstituted or substituted alkoxy group.

In the phenolic compound represented by the General Formula (G1) "$g_1$" to "$g_8$" represent individually any one of a hydrogen atom; alkyl group, such as a methyl group, ethyl group, n-propyl group, isopropyl group, n-butyl group and t-butyl group; benzyl group; substituted alkyl group, such as a methoxymethyl group and methoxyethyl group; alkoxycarbonyl group, such as a methoxycarbonyl group and ethoxycarbonyl group; substituted alkoxycarbonyl group, such as a benzyloxycarbonyl group and methoxyethylcarbonyl group; and aryl group, such as a phenyl group and naphthyl group. Examples of the substituent which "$g_1$" to "$g_8$" may have include an alkyl group, such as a methyl group and ethyl group; phenyl group; methoxy group; ethoxy group; phenoxy group; and halogen atom, such as a fluorine atom and chlorine atom.

The content of the phenolic compound in the photosensitive layer is preferably 0.1% by mass to 50% by mass, more preferably 0.1% by mass to 30% by mass. When the content is less than 0.1% by mass, satisfactory effect of the phenolic compound for improving the durability of the photoconductor in repeated use may not be achieved. On the other hand, when the content is more than 50% by mass, the lowering of the mechanical durability and sensitivity of the photoconductor may be caused.

Specific examples of the phenolic compound is not particularly limited and may be properly selected depending on the application, but compounds represented by the following Formulas (No. G1) to (No. G8) are preferred.

(No. G1)

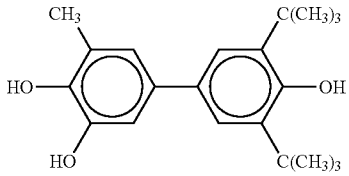

-continued (No. G2)

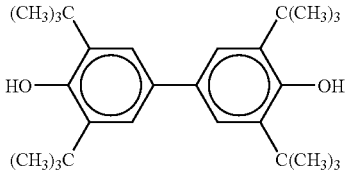

(No. G3)

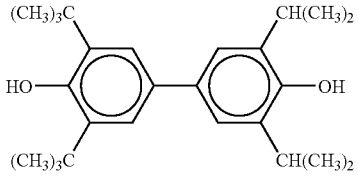

(No. G4)

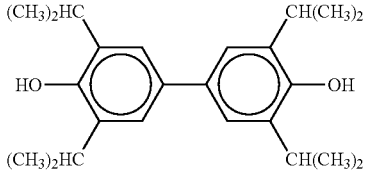

(No. G5)

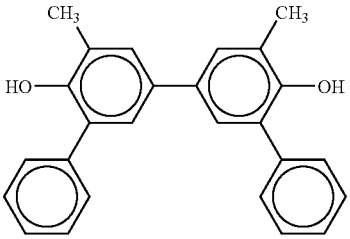

(No. G6)

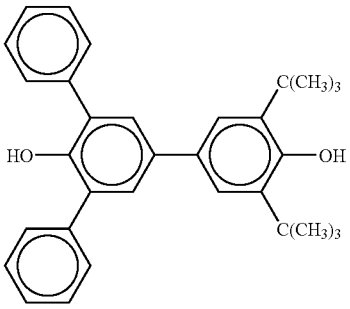

(No. G7)

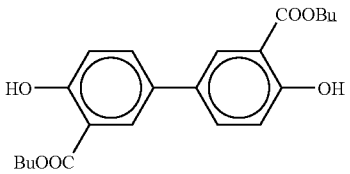

(No. G8)

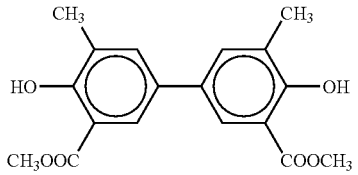

The photoconductor of the invention comprises a charge-generating material as an essential component. Examples of the charge-generating material include inorganic materials, such as selenium, selenium-tellurium, cadmium sulfide, cadmium sulfide-selenium and α-silicon; organic materials, such as CI Pigment Blue 25 (Color Index CI 21180), CI Pigment Red 41 (CI 21200), CI Acid Red 52 (CI 45100), CI Basic Red 3 (CI 45210), azo pigments, such as an azo pigment having a carbazole skeleton (JP-A No. 53-95033), azo pigment having a distyryl benzene skeleton (JP-A No. 53-133445), azo pigment having a triphenylamine skeleton (JP-A No. 53-132347), azo pigment having a dibenzothiophene skeleton (JP-A No. 54-21728), azo pigment having an oxadiazole skeleton (JP-A No. 54-12742), azo pigment having a fluorenone skeleton (JP-A No. 54-22834), azo pigment having a bisstilbene skeleton (JP-A No. 54-17733), azo pigment having a distyryloxadiazole skeleton (JP-A No. 54-2129), and azo pigment having a distyrylcarbazole skeleton (JP-A No. 54-14967); phthalocyanine pigments such as CI Pigment Blue 16 (CI 74100), and titanyl phthalocyanine; indigo pigments such as CI Vat Brown 5 (CI 73410), and CI Vat Dye (CI 73030); perylene pigments such as Argoscarlet B (manufactured by Bayer AG), and Indanthrene Scarlet R (manufactured by Bayer AG); and the like. These charge-generating materials may be employed alone or in combination.

Among the above-mentioned charge-generating materials, particularly by combining the phthalocyanine pigment with another charge-generating material, a photoconductor having high sensitivity and high durability can be obtained. Examples of the phthalocyanine pigment include a compound having a phthalocyanine skeleton represented by the following General Formula (N), in which M (central metal) represents any one of a metal and nonmetal (hydrogen) element.

General Formula (N)

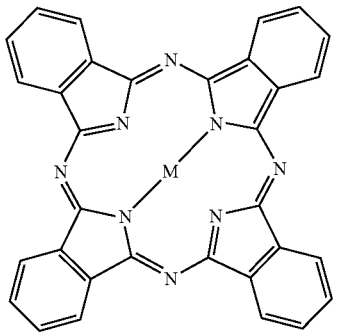

Examples of M (central metal) include an atom such as H, Li, Be, Na, Mg, Al, Si, K, Ca, Sc, Ti, V, Cr, Mn, Fe, Co, Ni, Cu, Zn, Ga, Ge, Y, Zr, Nb, Mo, Tc, Ru, Rh, Pd, Ag, Cd, In, Sn, Sb, Ba, Hf, Ta, W, Re, Os, Ir, Pt, Au, Hg, Ti, La, Ce, Pr, Nd, Pm, Sm, Eu, Gd, Th, Dy, Ho, Er, Tm, Yb, Lu, Th, Pa, U, Np and Am; and a combination of two or more elements, such as an oxide, chloride, fluoride, hydroxide and bromide. The central metal is not restricted to these elements.

The charge-generating material having a phthalocyanine skeleton according to this aspect may be a charge-transporting material having an oligomer structure, such as a dimer or trimer, and further may be a charge-generating material having a polymer structure, as long as the charge-generating material comprises the basic skeleton of the above-mentioned General Formula (N). The basic skeleton may have various substituents.

Among these various phthalocyanines, an oxotitanium phthalocyanine having TiO as the central metal and a metal-free phthalocyanine having H as the central metal M are particularly preferred from the viewpoint of photoconductor properties. Moreover, these phthalocyanines are known to have various crystal forms. For example, an oxotitanium phthalocyanine has α-, β-, γ-, m- and Y-crystal forms and a copper phthalocyanine has α-, β- and γ-crystal forms. Various properties of the phthalocyanines vary depending on the crystal form thereof, even if the central metal atom is the same. It is reported that among the above-mentioned various properties, the photoconductor properties vary depending on the crystal form of the phthalocyanine (see Electrophotography—the Society Journal—Vol. 29, No. 4 (1990)).

According to the above-mentioned report, each phthalocyanine has the optimal crystal form from the viewpoint of the photoconductor properties and particularly, the oxotitanium phthalocyanine is desired to have the Y-crystal form.

Further, a combination of two types of the charge-generating material having the phthalocyanine skeleton may be used as the charge-generating material, or a combination of the above-noted two types and further the charge-generating material other than the charge-generating material having the phthalocyanine skeleton may be mixed.

These pigments may be employed alone or in combination. The amount of the charge-generating material in the photosensitive layer is preferably 0.1% by mass to 40% by mass, more preferably 0.3% by mass to 25% by mass, based on the total mass of the photosensitive layer. The ratio of the charge-generating material to the charge-transporting polymer is preferably 5% by mass to 95% by mass.

Further, if required, the photosensitive layer may comprise a hole-transporting material having a low molecular mass in order to improve charging properties and sensitivity of the photoconductor.

Examples of the hole-transporting material having a low molecular mass include an oxazole derivative, oxadiazole derivative (described in JP-A Nos. 52-139065 and 52-139066), imidazole derivative, triphenylamine derivative (described in JP-A No. 3-285960), benzidine derivative (described in Japanese Patent Application Publication (JP-B) No. 58-32372), α-phenylstilbene derivative (described in JP-A No. 57-73075), hydrazone derivative (described in JP-A Nos. 55-154955, 55-156954, 55-52063 and 56-81850), triphenylmethane derivative (described in JP-B No. 51-10983), anthracene derivative (described in JP-A No. 51-94829), styryl derivative (described in JP-A Nos. 56-29245 and 58-198043), carbazol derivative (described in JP-A No. 58-58552), pyrene derivative (see JP-A No. 2-94812), and the like.

If required, the photosensitive layer may comprise an additive, such as a plasticizing agent, anti-oxidant, light stabilizer, heat stabilizer, lubricant or the like in order to improve charging properties. Examples of the plasticizing agent include a halogenated paraffin, dimethylnaphthalene and dibutylphthalate. Examples of the anti-oxidant or light stabilizer include a phenolic compound, hydroquinone compound, hindered phenolic compound, hindered amine compound and compound in which a hindered amine and a hindered phenol are present simultaneously in one molecule.

Examples of the support include a plate, drum or foil of a metal, such as aluminum, nickel, copper, titanium, gold and a stainless steel; a plastic film on which a film of aluminum, nickel, copper, titanium, gold, tin oxide or indium oxide is deposited; and a paper, plastic film or drum to which a conductive substance is applied.

An intermediate layer may be disposed on the support according to necessity. Generally, the intermediate layer comprises resins as a main component, taking into consideration that a coating liquid for forming the photosensitive layer is applied to the intermediate layer, it is desired that the resins comprised in the intermediate layer have high resistance to a general organic solvent.

Examples of such resins include water-soluble resins, such as a polyvinyl alcohol resin, casein resin and polyacrylate sodium; alcohol-soluble resins, such as a nylon copolymer and methoxymethylated nylon; and curable resins which can form a three-dimensional network, such as a polyurethane resin, melamine resin, phenolic resin, alkyd-melamine resin and epoxy resin.

The intermediate layer may comprise a fine-particle pigment of metal oxides, such as titanium oxide, silica, alumina, zirconium oxide, tin oxide and indium oxide in order to prevent the moiré of the image or lowering the residual potential of the photoconductor. The intermediate layer can be disposed, like the above-noted photosensitive layer, using a proper solvent according to a proper coating method. Further, the intermediate layer according to this aspect may comprise a silane coupling agent, a titanium coupling agent and a chromium coupling agent. Besides, a film of $Al_2O_3$ formed by anodizing; or a film of an organic compound, such as polyparaxylen (parylene) or of an inorganic compound, such as $SiO_2$, $SnO_2$, $TiO_2$, ITO and $CeO_2$, which is formed by a vacuum thin film forming method can also be suitably employed. Preferably, the intermediate layer has a thickness of 0 μm to 5 μm.

Further, for improving the mechanical durability, such as a resistance to friction, of the photoconductor, a protective layer may be disposed on the photosensitive layer.

Examples of the material for use in the protective layer include an ABS resin, ACS resin, olefin-vinylmonomer copolymer, chlorinated polyether resin, aryl resin, phenolic resin, polyacetal resin, polyamide resin, polyamideimide resin, polyacrylate resin, polyallylsulfon resin, polybutylene resin, polybutyleneterephthalate resin, polycarbonate resin, polyethersulfone resin, polyethylene resin, polyethyleneterephthalate resin, polyimide resin, acrylic resin, polypropylene resin, polyphenyleneoxide resin, polysulfone resin, polystyrene resin, AS resin, butadiene-styrene copolymer resin, polyurethane resin, polyvinyl chloride resin, polyvinylidene chloride resin, and epoxy resin.

For improving the wear resistance of the photoconductor, the protective layer may comprise fluorine-containing resins, such as polytetrafluoroethylene; silicone resins; and dispersions in which a inorganic material, such as titanium oxide, tin oxide and potassium titanate is dispersed in these resins.

The protective layer can be disposed according to a conventional coating method. Preferably, the protective layer has a thickness of about 0.1 μm to about 10 μm. In addition, a thin film of amorphous carbon (a-C), amorphous silicon carbide (a-SiC) and other conventional material formed by a vacuum thin film forming method can also be used as the protective layer.

The photoconductor is formed as follows. Specifically, the above-mentioned materials are dissolved or dispersed in an organic solvent to prepare a coating liquid for forming the photosensitive layer, this coating liquid is applied on the above-mentioned support or above the above-mentioned support via the intermediate layer by means of a dip coating, blade coating or spray coating, and is then dried to form the photosensitive layer. Further, if required, the charge-generating material may be dispersed in an organic solvent beforehand, and then other materials are dissolved or dispersed in the solution, thereby the coating liquid for forming the photosensitive layer may also be prepared. The dispersion can be carried out, for example, by means of a ball mill, ultrasonic wave, or homomixer.

The thickness of the photosensitive layer is preferably 5 μm to 100 μm, and more preferably 10 μm to 40 μm. When the thickness of the photosensitive layer is less than 5 μm, the charging properties of the photosensitive layer are lowered sometime. On the other hand, when the thickness of the photosensitive layer is more than 100 μm, the sensitivity of the photosensitive layer is lowered sometime.

Examples of the solvent used for preparing a dispersion liquid or solution for photosensitive layer include N,N-dimethylformamide, toluene, xylene, monochlorobenzene, 1,2-dichloroethane, 1,1,1-trichloroethane, dichloromethane, 1,1,2-trichloroethane, trichloroethylene, tetrahydrofuran, methyl ethyl ketone, methyl isobutyl ketone, cyclohexanone, ethyl acetate, butyl acetate, dioxane and dioxsolane.

If required, the photosensitive layer may comprise a binder in order to improve the charging properties, sensitivity and dispersion properties of the photosensitive layer. The binder used at the time of forming the photosensitive layer is not particularly restricted and may be any substances, so long as the binder is a conventional binder for an electrophotographic photoconductor having good electrically insulating properties.

Examples of the binder include addition polymerization-type resins, polyaddition-type resins and polycondensation-type resins, such as a polyethylene resin, polyvinyl butyral resin, polyvinyl formal resin, polystyrene resin, phenoxy resin, polypropylene resin, acrylic resin, methacrylic resin, vinyl chloride resin, vinyl acetate resin, epoxy resin, polyurethane resin, phenolic resin, polyester resin, alkyd resin, polycarbonate resin, polyamide resin, silicone resin and melamine resin; copolymer resins comprising two or more recurring units among recurring units of the above-mentioned resins, for example, electrically insulating resins, such as a vinyl chloride-vinyl acetate copolymer, styrene-acryl copolymer and vinyl chloride-vinyl acetate-maleic anhydride copolymer; and organic semiconductive polymers, such as poly-N-vinylcarbazole. These binders may be used alone or in combination.

The electrophotographic photoconductor for a liquid developing according to the invention is excellent in resistance to a carrier solvent, charging properties and sensitivity, and is suitable for from a low-speed copying process to a high-speed copying process. Further, by changing the type of the charge-generating material in the composition of the photosensitive layer, the spectral sensitivity of the photoconductor can be controlled, and thus the electrophotographic photoconductor for a liquid developing according to the invention can be applied to from photoconductors for analog copying machines for a monochrome or full color to photoconductors for page printers using an LD light or LED light as a light for the recording.

(Image-Forming Apparatus and Image-Forming Method)

The image-forming apparatus according to the invention comprises the electrophotographic photoconductor for a liquid developing of the invention, an electrostatic latent image forming unit, a developing unit, a transferring unit and a fixing unit, and may further comprise other units appropriately selected according to necessity, such as a charge-eliminating unit, a cleaning unit, a recycling unit and a controlling unit.

The image-forming method according to the invention comprises an electrostatic latent image forming step, developing step, transferring step and fixing step, and may further comprise other steps appropriately selected according to necessity, such as charge-eliminating step, cleaning step, recycling step and controlling step.

The image-forming method according to the invention can be preferably performed by the image-forming apparatus of the invention; the forming of the electrostatic latent image can be performed by the electrostatic latent image forming unit; the developing can be performed by the developing unit; the transferring can be performed by the transferring unit; the fixing can be performed by the fixing unit; and the other steps can be performed by the other units.

-Electrostatic Latent Image Forming Step and Electrostatic Latent Image Forming Unit- The electrostatic latent image forming step is one that forms an electrostatic latent image on an electrophotographic photoconductor. As the electrophotographic photoconductor, the electrophotographic photoconductor for liquid development according to the invention is employed.

The electrostatic latent image can be formed, for example, by charging uniformly the surface of the electrophotographic photoconductor, and then by exposing it imagewise, which can be performed by the electrostatic latent image forming unit.

The electrostatic latent image forming unit comprises, for example, a charger which uniformly charges the surface of the electrophotographic photoconductor, and an irradiator which exposes the surface of the electrophotographic photoconductor imagewise.

The charging can be performed, for example, by applying a voltage to the surface of the electrophotographic photoconductor, using the charger.

The charger is not particularly restricted and may be properly selected depending on the application. Examples of the charger include a non-contacting charger utilizing a corona discharge, such as a corotron and scorotron.

The exposing can be performed by exposing the surface of the electrophotographic photoconductor imagewise, using the irradiator for example.

The irradiator is not particularly restricted and may be properly selected depending on the application it can expose the surface of the electrophotographic photoconductor charged by the charger in the same way as the image to be formed, for example, a variety of irradiators such as copy optical system, rod lens array system, laser optical system, and liquid crystal shutter optical system may be exemplified.

-Developing Step and Developing Unit-

The developing step is one that develops the latent electrostatic image using a toner or developer to form a visual image.

The visible image may be formed, for example, by developing the latent electrostatic image using the toner or developer, which may be performed by the developing unit.

The developing unit utilizes a liquid developing method or wet developing method in which a developing solution containing toner particles dispersed in a solvent.

Examples of the solvent include hydrocarbon solvents, such as an aliphatic hydrocarbon solvent, which is called Isopar, and a paraffin solvent; silicone oils; and fluorine-containing oils.

-Transferring Step and Transferring Unit-

The transferring step is one that transfers the visible image to a recording medium.

The transferring step is not particularly restricted and may be properly selected depending on the application. For example, in one aspect, the transferring step is carried by directly transferring the visible image to a recording medium, in another aspect, the transferring step is carried as follows; using an intermediate image-transfer member, the visual image is primary transferred to an intermediate image-transfer member, and the transferred visual image is then secondary transferred to a recording medium, in another aspect, the transferring step comprises two transfer steps: primary transfer step in which the visible image is transferred to an intermediate image-transfer member to form a compounded transfer image; and second transfer step in which the compounded transfer image is transferred to an recording medium.

The transferring can be carried out, for example, by charging the electrophotographic photoconductor using a transferring charger, which can be performed by the transferring unit.

As the transferring unit, ones having at least an image-transferer which charges by releasing the visible image formed on the electrophotographic photoconductor to the recording-medium side are exemplified. There may be one transferring unit, or two or more transferring unit.

The image-transferer may be, for example, a corona transferring unit based on corona discharge, or the like.

The recording medium is typically plain paper, but is not particularly restricted and may be properly selected depending on the application, as long as an unfixed image after the developing can be transferred to the recording medium. Other materials such as polyethylene terephthalate (PET) sheets for overhead projector (OHP) may be utilized.

The fixing step is one that fixes the visible image transferred to the recording medium using a fixing apparatus. The fixing step may be carried out each time respective color toner images are transferred to the recording medium, alternatively, may be carried out in one operation when the respective color toner images have been laminated.

The fixing apparatus is not particularly restricted and may be properly selected depending on the application, but heat and pressure units known in the art are suitable. Examples of the heat and pressure unit include a combination of a heat roller and pressure roller, and a combination of a heat roller, pressure roller, and endless belt.

The heating temperature in the heat and pressure unit is, in general, preferably 80° C. to 200° C.

The charge-eliminating step is one that applies a discharge bias to the photoconductor to discharge it, which may be suitably performed by a charge-eliminating unit.

The charge-eliminating unit is not particularly restricted and may be properly selected from charge-eliminating units known in the art as long as it can apply a discharge bias to the electrophotographic photoconductor. Suitable examples thereof include discharge lamps and the like.

The cleaning step is one that removes electrophotographic toner remaining on the electrophotographic photoconductor, and may be suitably performed by a cleaning unit.

The cleaning unit is not particularly restricted and may be properly select from cleaning units known in the art as long as it can remove the electrophotographic toner remaining on the electrophotographic photoconductor. Preferred examples thereof include a magnetic brush cleaner, electrostatic brush cleaner, magnetic roller cleaner, blade cleaner, brush cleaner and web cleaner.

The recycling step is one that recycles the electrophotographic color toner removed in the cleaning step into the developing step, and may be suitably performed with use of the recycling unit. The recycling unit is not particularly restricted and may be properly selected from transport units known in the art.

The controlling step is one that controls the respective steps, and may be suitably carried out with use of the controlling unit.

The controlling unit is not particularly restricted as long as it can control operations of each of the units, and may be properly selected depending on the application. Examples thereof include devices, such as a sequencer and a computer.

Here, a wet developing system using a liquid developer according to this aspect will be described in more detail.

FIG. 1 is a schematic view for explaining the wet developing system using a liquid developer according to this aspect. The below-mentioned modified examples are also in the scope of this aspect.

In FIG. 1, a photoconductor 1 comprises a support and a single photosensitive layer thereon. The photoconductor 1 is in the form of a drum, but may be in the form of a sheet or an endless belt. As for a charger 2 and transferring charger 5, known units, including, a corotron, a scorotron, a solid state charger, and a charging roller are used.

As for the light source of an exposing unit 3, discharging lamp 6, or the like, light emitters including a fluorescent lamp, tungsten lamp, halogen lamp, mercury lamp, sodium lamp, light emitting diode (LED), laser diode (LD), and electro luminescence (EL) may be employed. For providing light only at a desired spectral region, a variety of filters such as a sharply cutting filter, bandpass filter, near-infrared cutting filter, dichroic filter, interference filter, and conversion filter for color temperature may be employed. In other steps than the steps shown in FIG. 1, such as transferring, destaticizing, cleaning and exposing which are performed in combination thereof with light-irradiating, the light is irradiated to the photoconductor 1.

The toner developed on the photoconductor 1 by the developing unit 4 is transferred to a transfer paper; however, the whole amount of the toner on the photoconductor is not transferred to the paper, but a portion of the toner on the photoconductor is remained on the photoconductor. The residual toner is removed from the photoconductor using a fur brush or cleaning blade. The cleaning is sometimes performed using only a cleaning brush. As the cleaning brush, brushes known in the art, including a fur brush and a magfur brush are used.

When a positive charge is applied to the electrophotographic photoconductor and image exposure is performed, a positive electrostatic latent image will be formed on the photoconductor surface. If the latent image is developed with a toner of negative polarity, a positive image will be obtained, and a negative image will be obtained if the latent image is developed with a toner of positive polarity. On the other hand, when a negative charge is applied to the electrophotographic photoconductor and image exposure is performed, a negative electrostatic latent image will be formed on the photoconductor surface. If the latent image is developed with a charge detecting particles of positive polarity, a positive image will be obtained, and a negative image will be obtained if the latent image is developed with a toner of negative polarity. Methods known in the art are applied for the developing unit and, methods known in the art are also used for the charge-eliminating unit.

The invention provides an electrophotographic photoconductor comprising a support, a single photosensitive layer disposed directly on the support or above the support via an intermediate layer, wherein the photosensitive layer comprises a charge-generating material, a charge-transporting material and an acceptor compound, and the charge-transporting material is a charge-transporting polymer represented by the General Formula (1). This electrophotographic photoconductor for liquid development achieves an electrophotographic photoconductor for liquid development, of which photosensitive layer has extremely high resistance to a carrier solvent for use in a wet developing method and having practically high sensitivity. In this way, the electrophotographic photoconductor for liquid development can be applied to a wet developing system for enhancing the image quality.

The invention will be illustrated in more detailed with reference to examples given below, but these are not to be construed as limiting the invention.

EXAMPLE 1

To an aluminum plate as a support, a polyamide resin solution in which polyamide resin (trade name: CM-8000; manufactured by Toray Industries, Inc.) was dissolved in a solvent mixture of methanol/butanol, was applied using a doctor blade and dried at 100° C. for 5 minutes to form an intermediate layer having a thickness of 0.5 μm.

Next, 0.5 g of X-type metal-free phthalocyanine and a solution containing 0.5 g of polymeric charge-transporting material (Exemplified Compound D-08, mass average molecular mass=128,700) and 19 g of tetrahydrofuran were dispersed using a ball mill, and then to the resultant dispersion, charge-transporting polymer (Exemplified Compound D-08, mass average molecular mass=128,700), acceptor compound represented by (Exemplified Compound A-1), tetrahydrofuran, and silicone oil (trade name: KF 50; manufactured by Sin-Etsu Chemical Co., Ltd.) were added, so that the contents of the pigment, charge-transporting polymer, acceptor compound, and silicone oil were respectively 2% by mass, 75.5% by mass, 22.5% by mass and 0.001% by mass to thereby prepare a coating liquid for photosensitive layer having a solid content of 20% by mass.

Thus prepared coating liquid for photosensitive layer was applied to the intermediate layer using a doctor blade, dried at 120° C. for 20 minutes to prepare a single-layer electrophotographic photoconductor (No. 1) comprising a photosensitive layer having a thickness of 20 μm.

EXAMPLE 2

0.5 g of metal-free phthalocyanine exemplified compounds and a solution containing 0.5 g of polymeric charge-transporting material (Exemplified Compound D-09, mass average molecular mass=136,900) and 19 g of tetrahydrofuran were dispersed using a ball mill, and then to the resultant dispersion, charge-transporting polymer (Exemplified Compound D-09, mass average molecular mass=136,900), acceptor compound represented by (Exemplified Compound A-1), tetrahydrofuran, and silicone oil (trade name: KF 50; manufactured by Sin-Etsu Chemical Co., Ltd.) were added, so that the contents of the pigment, charge-transporting polymer, acceptor compound, and silicone oil were respectively 2% by mass, 80% by mass, 18% by mass and 0.001% by mass to thereby prepare a coating liquid for photosensitive layer having a solid content of 20% by mass.

Thus prepared coating liquid for photosensitive layer was applied to an intermediate layer which was prepared in the same way as in Example 1, using a doctor blade, dried at 120° C. for 20 minutes to prepare a single-layer electrophotographic photoconductor (No. 2) comprising a photosensitive layer having a thickness of 20 μm.

EXAMPLE 3

A single-layer electrophotographic photoconductor (No. 3) was prepared in the same condition as in Example 1, expect that the charge-transporting polymer in Example 1 was replaced by charge-transporting polymer (Exemplified Compound D-15, mass average molecular mass=115,800).

EXAMPLE 4

A single-layer electrophotographic photoconductor (No. 4) was prepared in the same condition as in Example 1, expect that the acceptor compound in Example 1 was replaced by acceptor compound represented by (Exemplified Compound A-3).

EXAMPLE 5

A single-layer electrophotographic photoconductor (No. 5) was prepared in the same way as in Example 1, expect that in Example 1, charge-transporting polymer (Exemplified Compound D-08), acceptor compound represented by (Exemplified Compound A-1), phenolic compound (No. G2 of the specific examples), tetrahydrofuran, and silicone oil (trade name: KF 50; manufactured by Sin-Etsu Chemical Co., Ltd.) were added, so that the contents of the pigment, charge-transporting polymer, acceptor compound, phenolic compound, silicone oil were respectively 2% by mass, 75.5% by mass, 20% by mass, 2.5% by mass and 0.001% by mass to thereby prepare a coating liquid for photosensitive layer having a solid content of 20% by mass.

EXAMPLE 6

A single-layer electrophotographic photoconductor (No. 6) was prepared in the same way as in Example 1, expect that in Example 1, charge-transporting polymer (Exemplified Compound D-08), acceptor compound represented by (Exemplified Compound A-1), anti-oxidant (trade name: Sanol LS2626; manufactured by Sankyo Co., Ltd.), and silicone oil (trade name: KF 50; manufactured by Sin-Etsu Chemical Co., Ltd.) were added, so that the contents of the pigment, charge-transporting polymer, acceptor compound, anti-oxidant, silicone oil were respectively 2% by mass, 75.5% by mass, 20% by mass, 2.5% by mass and 0.001% by mass to thereby prepare a coating liquid for photosensitive layer having a solid content of 20% by mass.

COMPARATIVE EXAMPLE

To an aluminum plate as a support, a polyamide resin solution in which polyamide resin (trade name: CM-8000; manufactured by Toray Industries, Inc.) was dissolved in a solvent mixture of methanol/butanol, was applied using a doctor blade and dried at 100° C. for 5 minutes to form an intermediate layer having a thickness of 0.5 μm.

Next, 0.5 g of X-type metal-free phthalocyanine and a solution containing 0.5 g of polycarbonate Z (trade name: PC-Z; manufactured by Teijin Chemicals Ltd.) and 19 g of tetrahydrofuran were dispersed using a ball mill, and then to the resultant dispersion, charge-transporting material having a low molecular mass represented by the following Formula (T-1), acceptor compound represented by the (A-1), and silicone oil (trade name: KF 50; manufactured by Sin-Etsu Chemical Co., Ltd.) were added, so that the contents of the pigment, PC-Z, charge-transporting material, acceptor compound, and silicone oil were respectively 2% by mass, 50% by mass, 30% by mass, 18% by mass and 0.001% by mass to thereby prepare a coating liquid for photosensitive layer having a solid content of 20% by mass.

Formula (T-1)

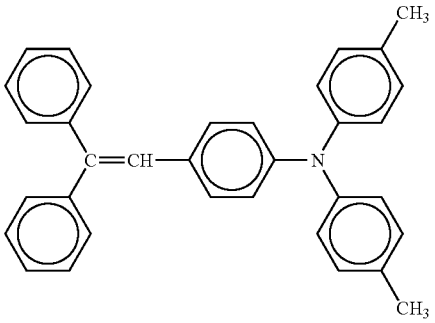

Thus prepared coating liquid for photosensitive layer was applied to the intermediate layer using a doctor blade, dried at 120° C. for 20 minutes to prepare a single-layer electrophotographic photoconductor comprising a photosensitive layer having a thickness of 20 μm.

Next, thus-obtained single-layer electrophotographic photoconductors of Examples and Comparative Example were evaluated as follows. Results are shown in Tables 1 to 7.

<Performance Evaluation and Test Condition>

A test piece of each of the single-layer electrophotographic photoconductors prepared in Examples and Comparative Example (55 mm×60 mm: subjected to edge treatment) was immersed in Isopar, which is a carrier solvent (manufactured by Exxon Chemicals Co., Ltd.), and silicone oil (trade name: SH200, 50 cSt; manufactured by Toray Dow Silicone Co., Ltd.), respectively in a dark atmosphere having a relative humidity of 50%, at 20° C.

At the start and after each period of the test, with respect to the change in appearance (visual observation of presence or absence of color change, of crack, or the like) and the photoconductor properties, each photoconductor was evaluated. With respect to the photoconductor properties, the surface potential $V_0$(V) and half decay exposure $Em_{1/2}$ (μJ/cm$^2$) were measured in an atmosphere having a relative humidity of 55% at 25° C., using a photoreceptor evaluation tester (trade name: EPA-8200; manufactured and sold by Kawaguchi Electric Works Co., Ltd.) as follows. Initially, the test piece was charged with an applying voltage of +6 kV for 20 seconds, was left to stand in a dark place for 20 seconds, and then the surface potential $V_0$(V) was measured. Next, a single color light having a wavelength of 700 nm was irradiated so that the illuminance at the surface of the test piece had been 2.5 μW/cm$^2$, and then the half decay exposure, which is required for reducing the surface potential from 800 V to 400 V, was measured.

TABLE 1

| Photoconductor | Immersion | Immersion in Isopar | | | Immersion in Silicone oil | | |
|---|---|---|---|---|---|---|---|
| | | Electrophotography Properties | | | Electrophotography Properties | | |
| No. 1 (Example 1) | time Initial | $V_0$(V) | $Em_{1/2}$ (μJ/cm$^2$) | Change in Appearance | $V_0$(V) | $Em_{1/2}$ (μJ/cm$^2$) | Change in Appearance |
| | | 871 | 0.35 | — | 855 | 0.35 | — |
| | 1 day | 863 | 0.35 | none | 865 | 0.34 | none |
| | 7 days | 854 | 0.35 | none | 876 | 0.34 | none |
| | 50 days | 847 | 0.34 | none | 834 | 0.34 | none |

TABLE 2

| Photoconductor | Immersion | Immersion in Isopar | | | Immersion in Silicone oil | | |
|---|---|---|---|---|---|---|---|
| | | Electrophotography Properties | | | Electrophotography Properties | | |
| No. 2 (Example 2) | time Initial | $V_0$(V) | $Em_{1/2}$ (mJ/cm$^2$) | Change in Appearance | $V_0$(V) | $Em_{1/2}$ (mJ/cm$^2$) | Change in Appearance |
| | | 1067 | 0.39 | — | 1023 | 0.38 | — |
| | 1 day | 1059 | 0.38 | none | 1011 | 0.37 | none |
| | 7 days | 1042 | 0.38 | none | 1006 | 0.37 | none |
| | 50 days | 1030 | 0.38 | none | 997 | 0.37 | none |

TABLE 3

| Photoconductor | Immersion | Immersion in Isopar | | | Immersion in Silicone oil | | |
|---|---|---|---|---|---|---|---|
| | | Electrophotography Properties | | | Electrophotography Properties | | |
| No. 3 (Example 3) | time Initial | $V_0$(V) | $Em_{1/2}$ (mJ/cm$^2$) | Change in Appearance | $V_0$(V) | $Em_{1/2}$ (μJ/cm$^2$) | Change in Appearance |
| | | 955 | 0.34 | — | 887 | 0.34 | — |
| | 1 day | 949 | 0.33 | none | 871 | 0.34 | none |
| | 7 days | 935 | 0.33 | none | 852 | 0.33 | none |
| | 50 days | 916 | 0.33 | none | 849 | 0.34 | none |

TABLE 4

| Photoconductor | Immersion | Immersion in Isopar | | | Immersion in Silicone oil | | |
|---|---|---|---|---|---|---|---|
| | | Electrophotography Properties | | | Electrophotography Properties | | |
| No. 4 (Example 4) | time Initial | $V_0$(V) | $Em_{1/2}$ (mJ/cm$^2$) | Change in Appearance | $V_0$(V) | $Em_{1/2}$ (mJ/cm$^2$) | Change in Appearance |
| | | 987 | 0.38 | — | 981 | 0.38 | — |
| | 1 day | 972 | 0.38 | none | 964 | 0.37 | none |
| | 7 days | 956 | 0.37 | none | 950 | 0.36 | none |
| | 50 days | 936 | 0.36 | none | 931 | 0.36 | none |

TABLE 5

| Photoconductor | Immersion | Immersion in Isopar | | | Immersion in Silicone oil | | |
|---|---|---|---|---|---|---|---|
| | | Electrophotography Properties | | | Electrophotography Properties | | |
| No. 5 (Example 5) | time Initial | $V_0$(V) | $Em_{1/2}$ (mJ/cm$^2$) | Change in Appearance | $V_0$(V) | $Em_{1/2}$ (mJ/cm$^2$) | Change in Appearance |
| | | 975 | 0.36 | — | 943 | 0.37 | — |
| | 1 day | 969 | 0.36 | none | 931 | 0.36 | none |
| | 7 days | 954 | 0.35 | none | 925 | 0.36 | none |
| | 50 days | 965 | 0.35 | none | 903 | 0.35 | none |

TABLE 6

| Photoconductor | Immersion | Immersion in Isopar | | | Immersion in Silicone oil | | |
|---|---|---|---|---|---|---|---|
| | | Electrophotography Properties | | | Electrophotography Properties | | |
| No. 6 (Example 6) | time Initial | $V_0$(V) | $Em_{1/2}$ (mJ/cm$^2$) | Change in Appearance | $V_0$(V) | $Em_{1/2}$ (mJ/cm$^2$) | Change in Appearance |
| | | 923 | 0.37 | — | 909 | 0.38 | — |
| | 1 day | 903 | 0.36 | none | 995 | 0.37 | none |
| | 7 days | 894 | 0.36 | none | 980 | 0.37 | none |
| | 50 days | 870 | 0.35 | none | 968 | 0.36 | none |

TABLE 7

| Photoconductor | Immersion | Immersion in Isopar | | | Immersion in Silicone oil | | |
|---|---|---|---|---|---|---|---|
| | | Electrophotography Properties | | | Electrophotography Properties | | |
| No. 7 (Comp. Example 1) | time Initial | $V_0$(V) | $Em_{1/2}$ (μJ/cm$^2$) | Change in Appearance | $V_0$(V) | $Em_{1/2}$ (μJ/cm$^2$) | Change in Appearance |
| | | 856 | 0.41 | — | 846 | 0.41 | — |
| | 1 day | 1253 | 2.83 | Change in color | 853 | 0.40 | none |
| | 7 days | Immeasurable | Immeasurable | Change in color | 891 | 0.42 | none |
| | 50 days | Immeasurable | Immeasurable | Change in color | 957 | 0.46 | Change in color |

What is claimed is:

1. An electrophotographic photoconductor for liquid development, comprising:

a support; and a photosensitive layer on or above the support, wherein the photosensitive layer comprises a charge-generating material, a charge-transporting material and an acceptor compound, wherein the charge-transporting material comprises a charge-transporting polymer represented by the following General Formula (1):

General Formula (1)

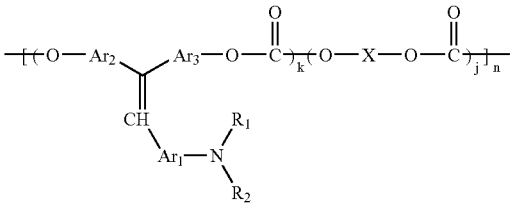

where, in the General Formula (1), $R_1$ and $R_2$ may be the same or different and represent an unsubstituted or substituted aryl group; $Ar_1$, $Ar_2$, and $Ar_3$ may be the same as or different from each other and represent an unsubstituted or substituted arylene group; "k" and "j" represent a composition ratio and $0.1 \leqq k \leqq 1$, $0 \leqq j \leqq 0.9$; "n" represents a recurring unit and is an integer of 5 to 5,000; "X" represents a divalent aliphatic group, a divalent cyclic aliphatic group, or a divalent group represented by the following General Formula (A):

General Formula (A)

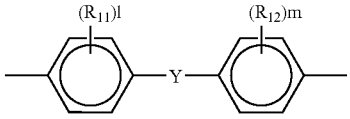

where, in the General Formula (A), $R_{11}$ and $R_{12}$ may be the same or different and represent an unsubstituted or substituted alkyl group, an unsubstituted or substituted aryl group, or a halogen atom; "l" and "m" represents an integer of 0 to 4; "Y" represents a single bond, a straight, branched, or cyclic alkylene group having a carbon number of 1 to 12, —O—, —S—, —SO—, —$SO_2$—, —CO—, —CO—O-Z-O—CO— (in the formula, "Z" represents a divalent aliphatic group), or a group represented by the following General Formula (B):

General Formula (B)

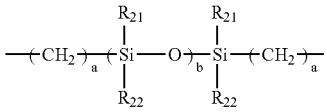

where, in the General Formula (B), "a" represents an integer of 1 to 20, and "b" represents an integer of 1 to 2,000; and $R_{21}$ and $R_{22}$ may be the same or different and represent an unsubstituted or substituted alkyl group, or unsubstituted or substituted aryl group.

2. The electrophotographic photoconductor for liquid development according to claim 1, wherein the photosensitive layer is a single layer.

3. The electrophotographic photoconductor for liquid development according to claim 1, further comprising an intermediate layer between the support and the photosensitive layer.

4. The electrophotographic photoconductor for liquid development according to claim 1, wherein the charge-transporting polymer is represented by the following General Formula (2):

General Formula (2)

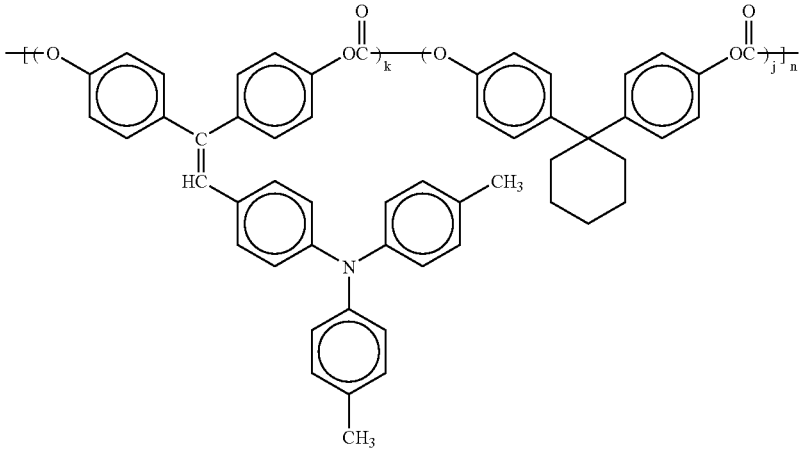

where, in the General Formula (2), "k" and "j" represent a composition ratio and $0.1 \leqq k \leqq 1$, $0 \leqq j \leqq 0.9$; and "n" represents a recurring unit and is an integer of 5 to 5,000.

5. The electrophotographic photoconductor for liquid development according to claim 1, wherein the charge-transporting polymer has a mass average molecular mass of 7,000 to 1,000,000 relative to polystyrene standards, determined by gel permeation chromatography.

6. The electrophotographic photoconductor for liquid development according to claim 1, wherein the content of the charge-transporting polymer in the photosensitive layer is 20% by mass to 95% by mass.

7. The electrophotographic photoconductor for liquid development according to claim 1, wherein the acceptor compound is a 2,3-diphenylindene compound represented by the following General Formula (F):

General Formula (F)

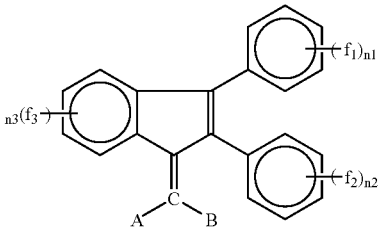

where, in the General Formula (F), $f_1$, $f_2$, and $f_3$ may be the same as or different from each other and represent any one of a hydrogen atom, a halogen atom, a cyano group, a nitro group and an alkyl group which may be substituted with a substituent; "A" and "B" may be the same or different, and represent individually any one of a hydrogen atom, a cyano group, an aryl group which may be substituted with a substituent, an alkoxycarbonyl group which may be substituted with a substituent, and an aryloxycarbonyl group which may be substituted with a substituent; "n1" and "n2" represent an integer of 0 to 5; and "n3" represents an integer of 0 to 5.

8. The electrophotographic photoconductor for liquid development according to claim 1, wherein the content of the acceptor compound in the photosensitive layer is 1% by mass to 40% by mass.

9. The electrophotographic photoconductor for liquid development according to claim 1, wherein the photosensitive layer comprises at least one of phenolic compounds represented by the following General Formula (G1):

General Formula (G1)

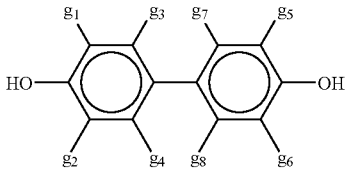

where, in the General Formula (G1), "$g_1$" to "$g_8$" represent a hydrogen atom, an unsubstituted or substituted alkyl group, an unsubstituted or substituted alkoxycarbonyl group, an unsubstituted or substituted aryl group, or an unsubstituted or substituted alkoxy group.

10. The electrophotographic photoconductor for liquid development according to claim 9, wherein the content of the phenolic compound in the photosensitive layer is 0.1% by mass to 50% by mass.

11. An image-forming apparatus comprising:

an electrophotographic photoconductor;

an electrostatic latent image forming unit configured to form an electrostatic latent image on the electrophotographic photoconductor;

a developing unit configured to develop the electrostatic latent image by means of a toner to form a visible image;

a transferring unit configured to transfer the visible image on a recording medium; and a fixing unit configured to fix the transferred image on the recording medium, wherein the electrophotographic photoconductor comprises:

a support; and a photosensitive layer on or above the support, wherein the photosensitive layer comprises a charge-generating material, a charge-transporting material and an acceptor compound, wherein the charge-transporting material comprises a charge-transporting polymer represented by the following General Formula (1):

General Formula (1)

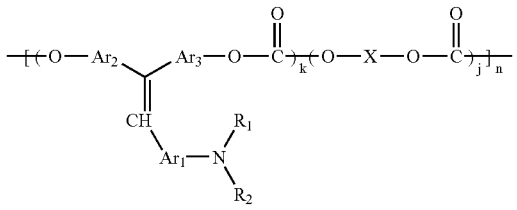

where, in the General Formula (1), $R_1$ and $R_2$ may be the same or different and represent an unsubstituted or substituted aryl group; $Ar_1$, $Ar_2$, and $Ar_3$ may be the same as or different from each other and represent an unsubstituted or substituted arylene group; "k" and "j" represent a composition ratio and $0.1 \leqq k \leqq 1$, $0 \leqq j \leqq 0.9$; "n" represents a recurring unit and is an integer of 5 to 5,000; "X" represents a divalent aliphatic group, a divalent cyclic aliphatic group, or a divalent group represented by the following General Formula (A):

General Formula (A)

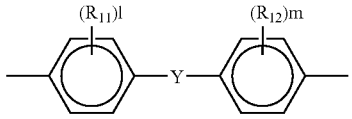

where, in the General Formula (A), $R_{11}$ and $R_{12}$ may be the same or different and represent an unsubstituted or substituted alkyl group, an unsubstituted or substituted aryl group, or a halogen atom; "l" and "m" represents an integer of 0 to 4; "Y" represents a single bond, a straight, branched, or cyclic alkylene group having a carbon number of 1 to 12, —O—, —S—, —SO—, —$SO_2$—, —CO—, —CO—O-Z-O—CO— (in the formula, "Z" represents a divalent aliphatic group), or a group represented by the following General Formula (B):

General Formula (B)

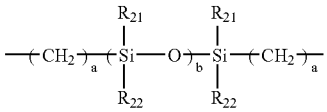

where, in the General Formula (B), "a" represents an integer of 1 to 20, and "b" represents an integer of 1 to 2,000; and $R_{21}$ and $R_{22}$ may be the same or different and represent an unsubstituted or substituted alkyl group, or unsubstituted or substituted aryl group.

12. An image forming method comprising:

forming an electrostatic latent image on an electrophotographic photoconductor;

developing the electrostatic latent image by means of a toner to form a visible image;

transferring the visible image on a recording medium; and fixing the transferred image on the recording medium, wherein the electrophotographic photoconductor comprises:

a support; and a photosensitive layer on or above the support, wherein the photosensitive layer comprises a charge-generating material, a charge-transporting material and an acceptor compound, wherein the charge-transporting material comprises a charge-transporting polymer represented by the following General Formula (1):

General Formula (1)

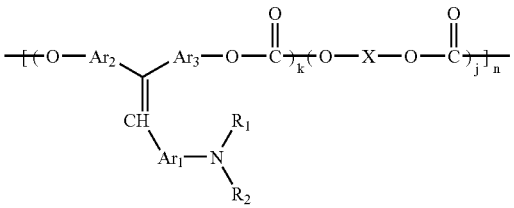

where, in the General Formula (1), $R_1$ and $R_2$ may be the same or different and represent an unsubstituted or substituted aryl group; $Ar_1$, $Ar_2$, and $Ar_3$ may be the same as or different from each other and represent an unsubstituted or substituted arylene group; "k" and "j" represent a composition ratio and $0.1 \leqq k \leqq 1$, $0 \leqq j \leqq 0.9$; "n" represents a recurring unit and is an integer of 5 to 5,000; "X" represents a divalent aliphatic group, a divalent cyclic aliphatic group, or a divalent group represented by the following General Formula (A):

General Formula (A)

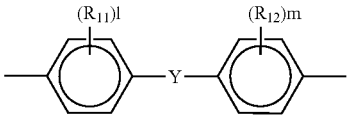

where, in the General Formula (A), $R_{11}$ and $R_{12}$ may be the same or different and represent an unsubstituted or substituted alkyl group, an unsubstituted or substituted aryl group, or a halogen atom; "l" and "m" represents an integer of 0 to 4; "Y" represents a single bond, a straight, branched, or cyclic alkylene group having a carbon number of 1 to 12, —O—, —S—, —SO—, —$SO_2$—, —CO—, —CO—O-Z-O—CO— (in the formula, "Z" represents a divalent aliphatic group), or a group represented by the following General Formula (B):

General Formula (B)

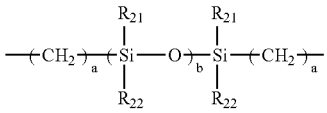

where, in the General Formula (B), "a" represents an integer of 1 to 20, and "b" represents an integer of 1 to 2,000; and $R_{21}$ and $R_{22}$ may be the same or different and represent an unsubstituted or substituted alkyl group, or unsubstituted or substituted aryl group.

* * * * *